US008888204B2

(12) United States Patent
Iritani et al.

(10) Patent No.: US 8,888,204 B2
(45) Date of Patent: Nov. 18, 2014

(54) INKJET PRINTING APPARATUS AND INKJET PRINTING METHOD

(75) Inventors: Hinako Iritani, Kawasaki (JP); Hiroshi Tajika, Yokohama (JP); Yuji Konno, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 92 days.

(21) Appl. No.: 13/218,598

(22) Filed: Aug. 26, 2011

(65) Prior Publication Data

US 2012/0050362 A1 Mar. 1, 2012

(30) Foreign Application Priority Data

Aug. 31, 2010 (JP) ..... 2010-194735

(51) Int. Cl.
*B41J 29/38* (2006.01)
*B41J 2/21* (2006.01)

(52) U.S. Cl.
CPC ..... *B41J 29/38* (2013.01); *B41J 2/2114* (2013.01)
USPC ..... 347/6; 347/98

(58) Field of Classification Search
USPC ..... 347/96, 98, 68, 5, 6, 14, 15, 21
See application file for complete search history.

(56) References Cited

U.S. PATENT DOCUMENTS 6,089,697 A 7/2000 Tajika et al.
6,120,141 A * 9/2000 Tajika et al. ..... 347/96
6,264,320 B1 7/2001 Moriyama et al.
6,412,934 B1 7/2002 Moriyama et al.
6,834,947 B2 12/2004 Moriyama et al.
2005/0156964 A1* 7/2005 Hoshino ..... 347/9
2007/0188541 A1* 8/2007 Hoshino ..... 347/21
2010/0177357 A1* 7/2010 Yoshida ..... 358/3.21
2011/0032299 A1* 2/2011 Mimura ..... 347/15
2011/0216110 A1* 9/2011 Kunimine et al. ..... 347/5
2011/0222126 A1* 9/2011 Asai et al. ..... 358/3.06
2011/0242176 A1* 10/2011 Iritani et al. ..... 347/15
2012/0050369 A1* 3/2012 Seki et al. ..... 347/15

FOREIGN PATENT DOCUMENTS

JP 4003760 B2 11/2007

OTHER PUBLICATIONS

English Machine Translation of JP 4003760 B.*

* cited by examiner

*Primary Examiner* — Stephen Meier
*Assistant Examiner* — Sharon A Polk
(74) *Attorney, Agent, or Firm* — Fitzpatrick, Cella, Harper & Scinto

(57) ABSTRACT

It is an object of this invention to provide an inkjet printing apparatus that can print an image with high uniformity in image clarity and gloss level irrespective of the gradation value of the image. The print head of this invention can eject color inks and an image quality improvement liquid that changes at least the gloss level or image clarity of the image. The print head scans over same print areas of a print medium to form an image and at the same time applies the image quality improvement liquid onto the image. A control unit raises the volume of the image quality improvement liquid applied to unit areas in a relatively subsequent scan to the volume of the image quality improvement liquid applied to unit areas in a relatively preceding scan at a rate that corresponds to the volume of the color ink applied to the unit areas.

30 Claims, 21 Drawing Sheets

| GRAYSCALE | CLARITY | GLOSS LEVEL |
|---|---|---|
| HIGHLIGHT | HIGH | LOW (1) |
| HALF-TONE | HIGH (3) | HIGH (2) |
| SHADOW | MEDIUM | (4) HIGH |
| TARGET | MEDIUM | MEDIUM |

FIG.1

| | | INKS | | | | | | | | | |
|---|---|---|---|---|---|---|---|---|---|---|---|
| | | 1 | 2 | 3 | 4 | 5 | 6 | 7 | 8 | 9 | 10 |
| PIGMENT DISPERSANT | 1 | 40 | 8 | | | | | | | | |
| | 2 | | | 20 | 8 | | | | | | |
| | 3 | | | | | 40 | | | | | |
| | 4 | | | | | | 40 | 20 | 8 | | |
| | 5 | | | | | | | | | 20 | |
| | 6 | | | | | | | | | | 20 |
| GLYCERIN | | 5.0 | 5.0 | 5.0 | 5.0 | 5.0 | 5.0 | 5.0 | 5.0 | 5.0 | 5.0 |
| DIETHYLENE GLYCOL | | 5.0 | 5.0 | 5.0 | 5.0 | 5.0 | 5.0 | 5.0 | 5.0 | 5.0 | 5.0 |
| POLYETHYLENE GLYCOL 1000 | | 5.0 | 5.0 | 5.0 | 5.0 | 5.0 | 5.0 | 5.0 | 5.0 | 5.0 | 5.0 |
| SURFYNOL 465 | | 1.0 | 1.0 | 1.0 | 1.0 | 1.0 | 1.0 | 1.0 | 1.0 | 1.0 | 1.0 |
| DEIONIZED WATER | | 44 | 76 | 64 | 76 | 44 | 44 | 64 | 76 | 64 | 64 |

FIG.7

NORMAL PRINTING MASK FOR IMAGE QUALITY IMPROVEMENT LIQUID (M1)

| | | | |
|---|---|---|---|
| 4 | 2 | 3 | 1 |
| 1 | 3 | 4 | 2 |
| 2 | 4 | 1 | 3 |
| 3 | 1 | 2 | 4 |

PRINT-PERMITTED AREA IN 1ST SCAN

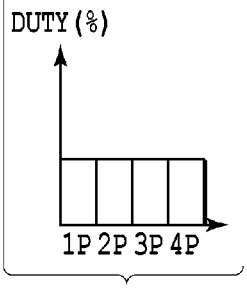

FIG.13A

LIQUID-OVER-INK PRINTING MASK FOR IMAGE QUALITY IMPROVEMENT LIQUID (M2)

| | | | |
|---|---|---|---|
| 1 | 4 | 3 | 4 |
| 2 | 3 | 3 | 2 |
| 3 | 4 | 4 | 2 |
| 4 | 3 | 4 | 4 |

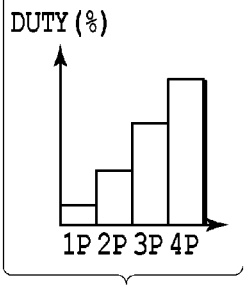

FIG.13B

COLOR INK MASK (M3)

| | | | |
|---|---|---|---|
| 4 | 3 | 2 | 1 |
| 3 | 2 | 1 | 4 |
| 2 | 1 | 4 | 3 |
| 1 | 4 | 3 | 2 |

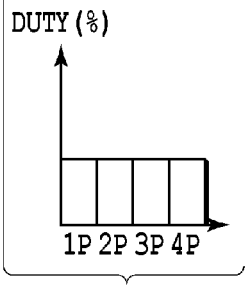

FIG.13C

OVERLAPPING

NORMAL PRINTING MASK

| | | | |
|---|---|---|---|
| △ | × | ○ | △ |
| × | ○ | ○ | × |
| △ | ○ | × | △ |
| ○ | × | × | ○ |

LIQUID-OVER-INK PRINTING MASK

| | | | |
|---|---|---|---|
| × | ○ | ○ | ○ |
| × | ○ | ○ | × |
| ○ | ○ | △ | × |
| ○ | × | ○ | ○ |

RATIOS FOR ○, △, ×

NORMAL PRINTING MASK:

○ : $\frac{6}{16}$

△ : $\frac{4}{16}$

× : $\frac{6}{16}$

LIQUID-OVER-INK PRINTING MASK:

○ : $\frac{10}{16}$

△ : $\frac{1}{16}$

× : $\frac{5}{16}$

○ : SUBPIXEL PRINTED WITH TREATMENT LIQUID IN LATER SCAN THAN COLOR INK

△ : SUBPIXEL PRINTED WITH TREATMENT LIQUID IN SAME SCAN AS COLOR INK

× : SUBPIXEL PRINTED WITH TREATMENT LIQUID IN EARLIER SCAN THAN COLOR INK

FIG.13D

| GRAYSCALE | VOLUME OF COLOR INK | IMAGE QUALITY IMPROVEMENT LIQUID MASK |
|---|---|---|
| HIGHLIGHT | $0\% \leq V < 15\%$ | NORMAL PRINTING MASK |
| HALF-TONE | $15\% \leq V < 50\%$ | NORMAL PRINTING MASK |
| SHADOW | $50\% \leq V$ | LIQUID-OVER-INK PRINTING MASK |

FIG.14

| VOLUME OF COLOR INKS APPLIED | COLOR INK | | |
|---|---|---|---|
| | PRIMARY | SECONDARY | TERTIARY |
| 0% ≤ V < 15% | NORMAL PRINTING | NORMAL PRINTING | NORMAL PRINTING |
| 15% ≤ V < 50% | NORMAL PRINTING | NORMAL PRINTING | LIQUID-OVER-INK PRINTING |
| 50% ≤ V < 75% | NORMAL PRINTING | LIQUID-OVER-INK PRINTING | LIQUID-OVER-INK PRINTING |
| 75% ≤ V | LIQUID-OVER-INK PRINTING | LIQUID-OVER-INK PRINTING | LIQUID-OVER-INK PRINTING |

FIG.16

| | | Ma INK VOLUME (%) | | | | | |
|---|---|---|---|---|---|---|---|
| | | V < 7.5% | 7.5% ≤ V < 25% | 25% ≤ V < 37.5% | 37.5% ≤ V < 50% | 50% ≤ V < 75% | 75% ≤ V |
| Cy INK VOLUME (%) | V < 7.5% | NORMAL PRINTING | NORMAL PRINTING | NORMAL PRINTING | NORMAL PRINTING | NORMAL PRINTING | LIQUID-OVER-INK PRINTING |
| | 7.5% ≤ V < 25% | NORMAL PRINTING | NORMAL PRINTING | NORMAL PRINTING | NORMAL PRINTING | LIQUID-OVER-INK PRINTING | LIQUID-OVER-INK PRINTING |
| | 25% ≤ V < 37.5% | NORMAL PRINTING | NORMAL PRINTING | NORMAL PRINTING | LIQUID-OVER-INK PRINTING | LIQUID-OVER-INK PRINTING | LIQUID-OVER-INK PRINTING |
| | 37.5% ≤ V < 50% | NORMAL PRINTING | NORMAL PRINTING | LIQUID-OVER-INK PRINTING | LIQUID-OVER-INK PRINTING | LIQUID-OVER-INK PRINTING | LIQUID-OVER-INK PRINTING |
| | 50% ≤ V < 75% | NORMAL PRINTING | LIQUID-OVER-INK PRINTING | LIQUID-OVER-INK PRINTING | LIQUID-OVER-INK PRINTING | LIQUID-OVER-INK PRINTING | LIQUID-OVER-INK PRINTING |
| | 75% ≤ V | LIQUID-OVER-INK PRINTING | LIQUID-OVER-INK PRINTING | LIQUID-OVER-INK PRINTING | LIQUID-OVER-INK PRINTING | LIQUID-OVER-INK PRINTING | LIQUID-OVER-INK PRINTING |

FIG.17

DATA SHOWING INK VOLUME IN EACH PIXEL

600dpi

| INK APPLIED INSIDE PIXEL | | | | | |
|---|---|---|---|---|---|
| 30% | 30% | 30% | 100% | 110% | 120% |
| 60% | 40% | 30% | 120% | 110% | 130% |

FIG.18A

MASK SELECTION DATA WHEN IMPROVEMENT LIQUID MASK IS SELECTED FOR EVERY 1X1 PIXEL

| | | | | | | |
|---|---|---|---|---|---|---|
| MASK SELECTION RANGE A | A | A | A | B | B | B |
| MASK SELECTION RANGE B | B | A | A | B | B | B |

FIG.18B

MASK SELECTION DATA WHEN IMPROVEMENT LIQUID MASK IS SELECTED FOR EVERY 2X2 PISEL

| | | | | | |
|---|---|---|---|---|---|
| A | A | B | B | B | B |
| A | A | B | B | B | B |

FIG.18C

INKJET PRINTING APPARATUS AND INKJET PRINTING METHOD

BACKGROUND OF THE INVENTION

1. Field of the Invention

The present invention relates to an inkjet printing apparatus and an inkjet printing method which use color inks containing colorants and an image quality improvement liquid, and more particularly to a technology for reducing gloss unevenness in printed images.

2. Description of the Related Art

There has been growing calls in recent years for the inkjet printing to have a capability to print high quality images on a variety of print mediums. Among the print mediums suited for high quality images, there is coated paper. The coated paper has an ink receiving layer formed on a substrate such as quality paper and film. There are various kinds of coated paper with varying degrees of texture, from glossy paper with a mirror surface to matte paper with a glare-free finish.

For these coated paper, there is a wide range of demands in terms of glossiness of printed images. One such demand is that the printed image be uniform in glossiness over the entire print medium. To meet this demand Japanese Patent No. 4003760 discloses a method that, in an inkjet printing apparatus using color inks and an image quality improvement liquid, alleviates gloss unevenness by adjusting the amount of image quality improvement liquid applied according to the volume of color inks used for printing.

Generally, in areas on glossy paper applied with a small volume of color inks, the level of gloss, which will be described later, is low compared with areas applied with a greater amount of inks. So, Japanese Patent No. 4003760 minimizes the gloss unevenness within the same image by applying a greater amount of image quality improvement liquid to the areas printed with a small volume of inks than to those areas printed with a larger volume of inks to enhance the level of gloss in the areas printed with a small ink volume.

However, as disclosed in Japanese Patent No. 4003760, with the method of making only the gloss level uniform by adjusting the amount of image quality improvement liquid, the uniformity of glossiness in the same image may not be able to be enhanced enough. This is considered due to the fact that the glossiness in an image is affected by not only the uniformity of gloss level but the uniformity of image clarity and that the image clarity and the gloss level change according to the gradation value of the printed areas.

FIG. 1 illustrates how the image clarity and the gloss level vary according to the gradation value. In FIG. 1, "medium" represents a target range of each of the image clarity and the gloss level; "high" represents a range higher than the target range; and "low" represents a range lower than the target range. As shown in FIG. 1, there is a tendency that, when compared with the target range, highlight areas are high in image clarity and low in gloss level, halftone areas are high in both image clarity and gloss level, and shadow areas (high density areas) are medium in image clarity and high in gloss level. This shows that the image clarity as well as the gloss level tends to vary according to the gradation value, which means that the user can recognize gloss unevenness when the image clarity uniformity is low even if the gloss level is uniform. The gloss unevenness in an image becomes particularly distinctive when the gloss level and the image clarity greatly vary between highlight areas and shadow areas.

SUMMARY OF THE INVENTION

Intended to overcome the above problem, the present invention has been accomplished to provide an inkjet printing apparatus and an inkjet printing method both of which can print images with high uniformity either in image clarity or gloss level irrespective of their gradation value.

To achieve the above objective, the invention has the following constructions.

As a first aspect of this invention, an inkjet printing apparatus, in which a print head that ejects at least one color ink containing a colorant and an image quality improvement liquid is scanned over same print area of a print medium a plurality of times to form an image on the print medium with the color ink and apply the image quality improvement liquid onto the printed image to change at least its gloss level or image clarity, the inkjet printing apparatus comprising: a control unit to control a volume of the image quality improvement liquid applied to unit areas included in the print area in each of the plurality of scans; wherein the control unit raises the volume of the image quality improvement liquid applied to unit areas in a_relatively subsequent scan to the volume of the image quality improvement liquid applied to unit areas in a_relatively preceding scan at a rate that corresponds to the volume of the color ink applied to the unit areas.

As a second aspect of this invention, an inkjet printing apparatus, in which a print head that ejects at least one color ink containing a colorant and an image quality improvement liquid is scanned over same print area of a print medium a plurality of times to form an image on the print medium with the color ink and apply the image quality improvement liquid onto the printed image to change at least its gloss level or image clarity, the inkjet printing apparatus comprising: a control unit to control a volume of the image quality improvement liquid applied to unit areas included in the print area in each of the plurality of scans; wherein the control unit raises the volume of the image quality improvement liquid applied to unit areas in a relatively subsequent scan to the volume of the image quality improvement liquid applied to unit areas in a relatively preceding scan at a rate that corresponds to a gradation value of the image represented by input image data for the unit areas.

With this invention, an image can be printed that is highly uniform in image clarity and gloss level without regard to the gradation value of the printed image. So the printed image has an excellent glossiness.

Further features of the present invention will become apparent from the following description of exemplary embodiments (with reference to the attached drawings).

BRIEF DESCRIPTION OF THE DRAWINGS

FIG. 1 is a diagram showing a relation among gradation value, image clarity and glossiness;

FIG. 7 shows a composition of inks used in the embodiment;

FIGS. 13A-13D explain how mask patterns work in first embodiment;

FIG. 14 shows a relation among a gradation value of an image, a volume of ink applied and a mask pattern in first embodiment;

FIG. 16 shows a relation among a gradation value of an image, an applied ink volume and a mask pattern in a third embodiment;

FIG. 17 shows a relation among a gradation value of an image, an applied ink volume and a mask pattern in a fourth embodiment;

FIGS. 18A-18C show image data areas used to calculate the volume of color inks applied, and corresponding mask unit areas in a fifth embodiment;

DESCRIPTION OF THE EMBODIMENTS

Now embodiments of this invention will be described by referring to the accompanying drawings.

(Image Quality Improvement Liquid)

First, the image quality improvement liquid and an improvement of glossiness are defined as follows.

In this invention the image quality improvement liquid refers to a colorless, transparent liquid used to improve at least the glossiness of a printed image. The improvement of glossiness means bringing levels of gloss and image clarity, both of which will be described later, close to desired ones.

(Method for Evaluating Gloss and Clarity Levels)

Next, in embodiments of this invention, an explanation will be given as to the gloss level and image clarity of the surface of a print medium, the criteria used to evaluate the uniformity of glossiness in an image, and a method for evaluating these properties.

Among the criteria to evaluate the glossiness of print media and images, there are gloss level and image clarity. Explanations will be given in the following as to the method of evaluating gloss level and image clarity and the relation between them.

Figure 2A:
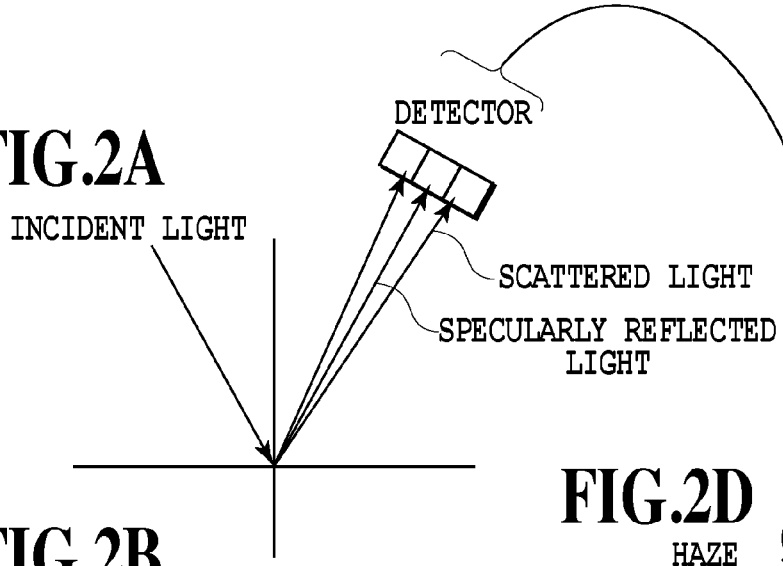
FIGS. 2A-2D explain the gloss level and haze.
Figure 2B:
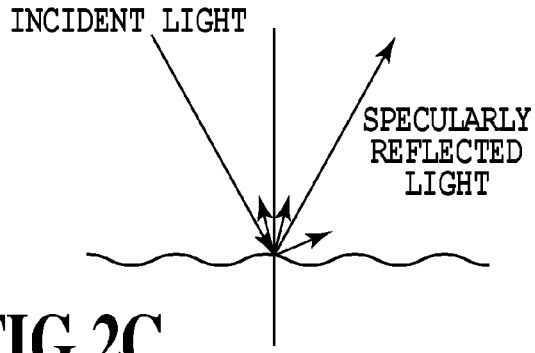
Figure 2C:
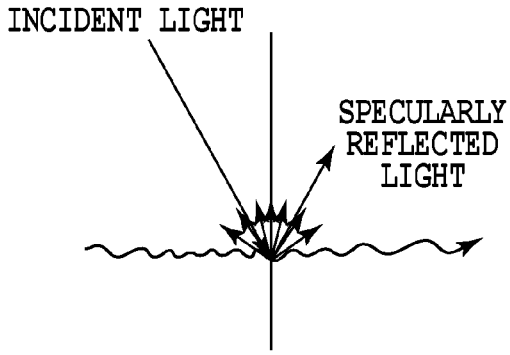
Figure 2D:
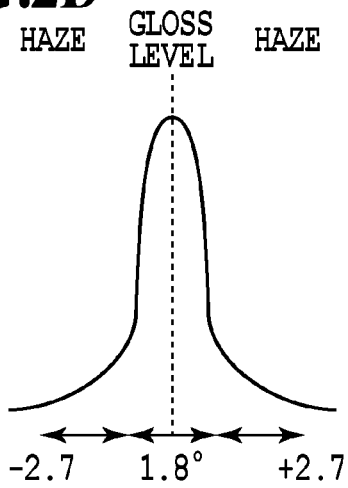

FIGS. 2A-2D show gloss level and haze. As shown in FIG. 2A, the level of mirror surface gloss (hereinafter referred to as gloss level) and the level of haze at an angle of 20° can be determined by a haze detector (e.g., B-4632 of BYK-Gardner, Japanese tradename of Micro-Haze Plus) detecting reflected light from the surface of a printed material. The reflected light is distributed through a certain angle centered at an axis of its specularly reflected light. As shown in FIG. 2D, the gloss level is detected in an aperture width of, for example, 1.8° centered at the center of the detector and the haze is detected in a range of, for example, ±2.7° outside the aperture width. That is, when a reflected light is observed, a rate of reflection of the specularly reflected light, which constitutes the center axis of the reflected light distribution, with respect to the incident light is defined as the gloss level. In the distribution of the reflected light, scattered light occurring near the specularly reflected light, when measured, is defined as haze or haze value. The gloss level and the haze value as measured by the detector have no dimensions in unit, with the gloss level conforming to K5600 of JIS (Japanese Industrial Standard) and the haze to DIS13803 of ISO standard.

The image clarity is measured by JIS H8686 "Method of Measuring Clarity of Anodic Oxide Film of Aluminum and Aluminum Alloy" or by JIS J7105 "Method of Testing Optical Characteristics of Plastics" and represents a sharpness of an image formed on a print medium. For example, when an illuminated image transferred onto a print medium is dull, the print medium has a low image clarity level.

FIGS. 2B and 2C show that the quantity of reflected light and its direction vary depending on a coarseness of the surface of a printed image. As shown in these figures, generally, as the surface becomes coarse, more of the reflected light is scattered and there is less of the specularly reflected light, resulting in the image clarity and the gloss level being measured as smaller values. In this embodiment, when the measured image clarity is smaller in value than the target value of the image clarity, this state is referred to as the image clarity being low. Further, when the measured gloss level is smaller than the target gloss level, this state is referred to as the gloss level being low.

(Relation Between Gloss Level and Clarity)

Figure 3A:
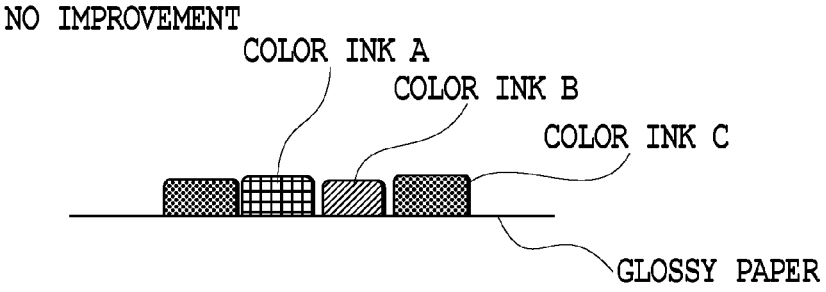
FIGS. 3A-3C show a difference in a printed surface caused by different ways that the color inks and the image quality improvement liquid overlap.
Figure 3B:
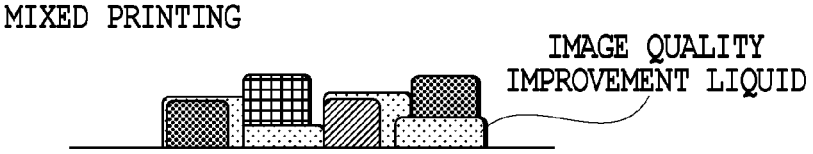
Figure 3C:
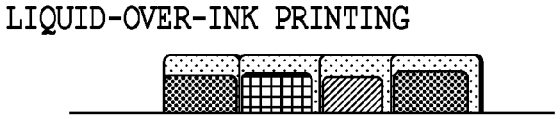

The gloss level and the image clarity in a printed image differ according to gradation values as described above (FIG. 1). If an image quality improvement liquid is applied to a print medium along with color inks, the image clarity and the gloss level change according to how they overlap each other. FIGS. 3A to 3C show states of a printed surface under different conditions in which the color inks and the image quality improvement liquid overlap each other. FIG. 3A shows a state of the printed surface when the image quality improvement liquid is not applied. FIGS. 3B and 3C show states of the printed surface when the image quality improvement liquid is applied by a normal printing procedure, which is commonly performed, and by an liquid-over-ink printing procedure, respectively. These two printing procedures will be described later.

In a printing procedure that performs printing such that areas applied with color inks followed by image quality improvement liquid and areas applied with image quality improvement liquid followed by color inks are randomly distributed on the print medium (this printing procedure is hereinafter referred to as a normal printing procedure), surface undulations in the printed areas increase, tending to reduce the image clarity and the gloss level (FIG. 3B). Further, as the volumes of color inks and image quality improvement liquid increase, the normal printing procedure increases the rate of reduction in image clarity and gloss level. This is considered due to the fact that the penetrability of the image quality improvement liquid dots into the underlying layer varies depending on its state, causing the dots after being fixed to vary in height from one area to another, forming an undulated surface.

Conversely, with a printing procedure that puts a relatively large time lag between a timing of applying color inks and a timing of applying image quality improvement liquid, the image clarity is less likely to degrade, with only the gloss level tending to change greatly according to the amount of color inks and image quality improvement liquid applied (FIG. 3C). Among them, a printing procedure that applies the image quality improvement liquid following the application of color inks (hereinafter referred to as a liquid-over-ink printing procedure), in particular, changes the gloss level of an image efficiently. That is, applying the image quality improvement liquid to an area where the gloss level is low enhances gloss level according to the amount of image quality improvement liquid applied (hereinafter referred to as a second effect). Applying the image quality improvement liquid to an area where the gloss level is high reduces gloss level (hereinafter referred to as a third effect).

To summarize, the image quality improvement liquid produces the following effects in terms of the gloss level and the image clarity according to the way the liquid is applied.

In highlight areas the application of the image quality improvement liquid by the normal printing procedure can enhance a refractive index of the print medium surface, increasing the gloss level (referred to as a first effect).

In half-tone areas, the application of the image quality improvement liquid by the normal printing procedure can enhance the undulation of the print medium surface, lowering the gloss level (referred to as a second effect).

In half-tone areas, the application of the image quality improvement liquid by the normal printing procedure can enhance the undulation of the print medium surface, lowering the image clarity, too (referred to as a third effect).

In shadow areas, the application of the image quality improvement liquid by the liquid-over-ink printing procedure can put the image quality improvement liquid with a relatively low refractive index over color inks with a high refractive index and thereby lower the refractive index of the print medium surface and its gloss level (referred to as a fourth effect).

Considering these effects produced by the image quality improvement liquid, this embodiment performs the normal printing procedure in highlight areas to raise the gloss level on the strength of the first effect (as indicated at (1) in FIG. 1). In half-tone areas the normal printing procedure is performed to lower the gloss level and image clarity by the second and third effects ((2) and (3) in FIG. 1). In shadow areas the liquid-over-ink printing procedure is done to lower the gloss level by the fourth effect ((4) in FIG. 1). By controlling the gloss level and image clarity within desired ranges by using the aforementioned advantageous effects, the uniformity of glossiness can be improved. It is noted that because glossiness unevenness in an image is large between the highlight areas and the shadow areas, the entire gradation range may be divided into two and the control may be performed to produce only the (i) first effect in the highlight areas and the (iv) fourth effect in the shadow areas.

In this embodiment, the image clarity is said to be "low" when its value is less than 55, "medium" when it is equal to or more than 55 and less than 60, and "high" when it is equal to or more than 60. Similarly, the gloss level is said to be "low" when its value is less than 60, "medium" when it is equal to or more than 60 and less than 80, and "high" when it is equal to or more than 80.

Next, the construction of the apparatus, ink compositions and image processing commonly employed in a first to an eighth embodiment will be described as follows.

(Construction of the Apparatus)

Figure 4:
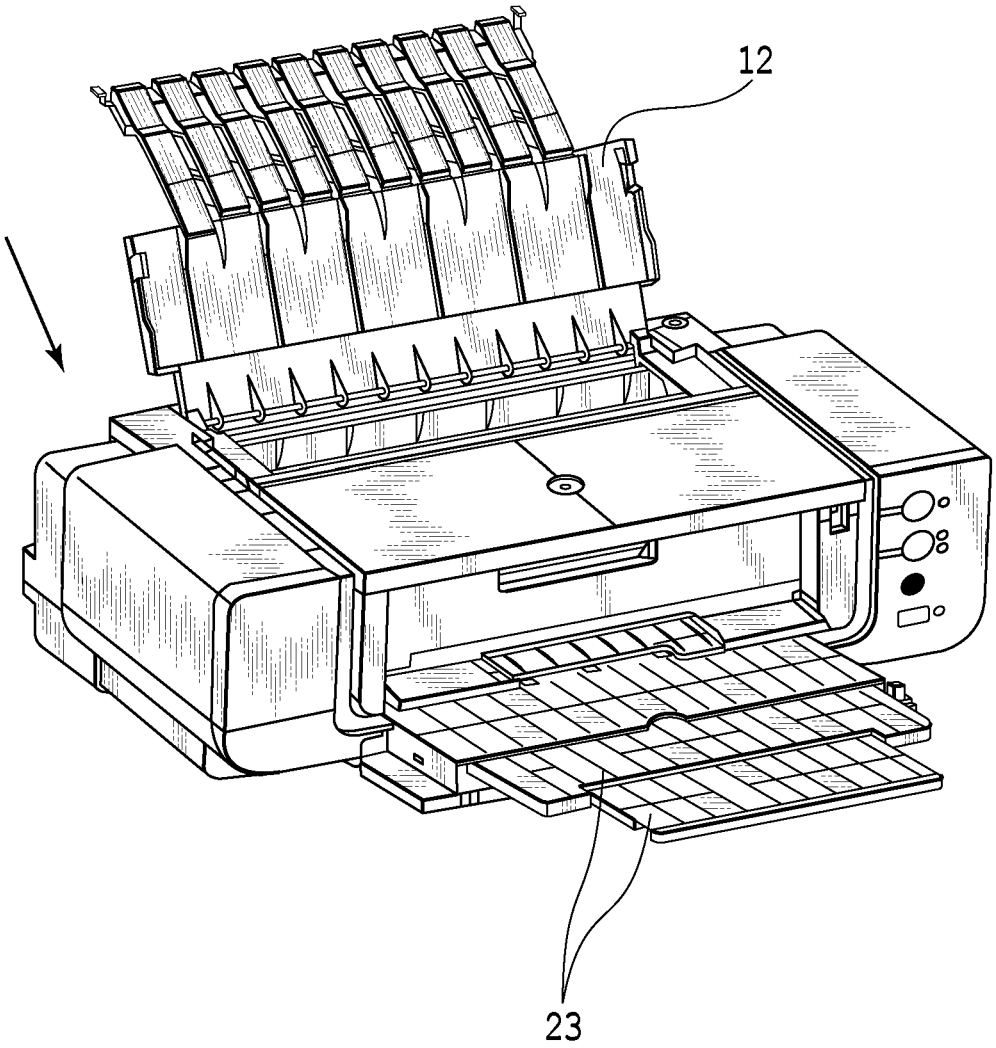
FIG. 4 is an external perspective view of an inkjet printing apparatus used in this embodiment.
Figure 5:
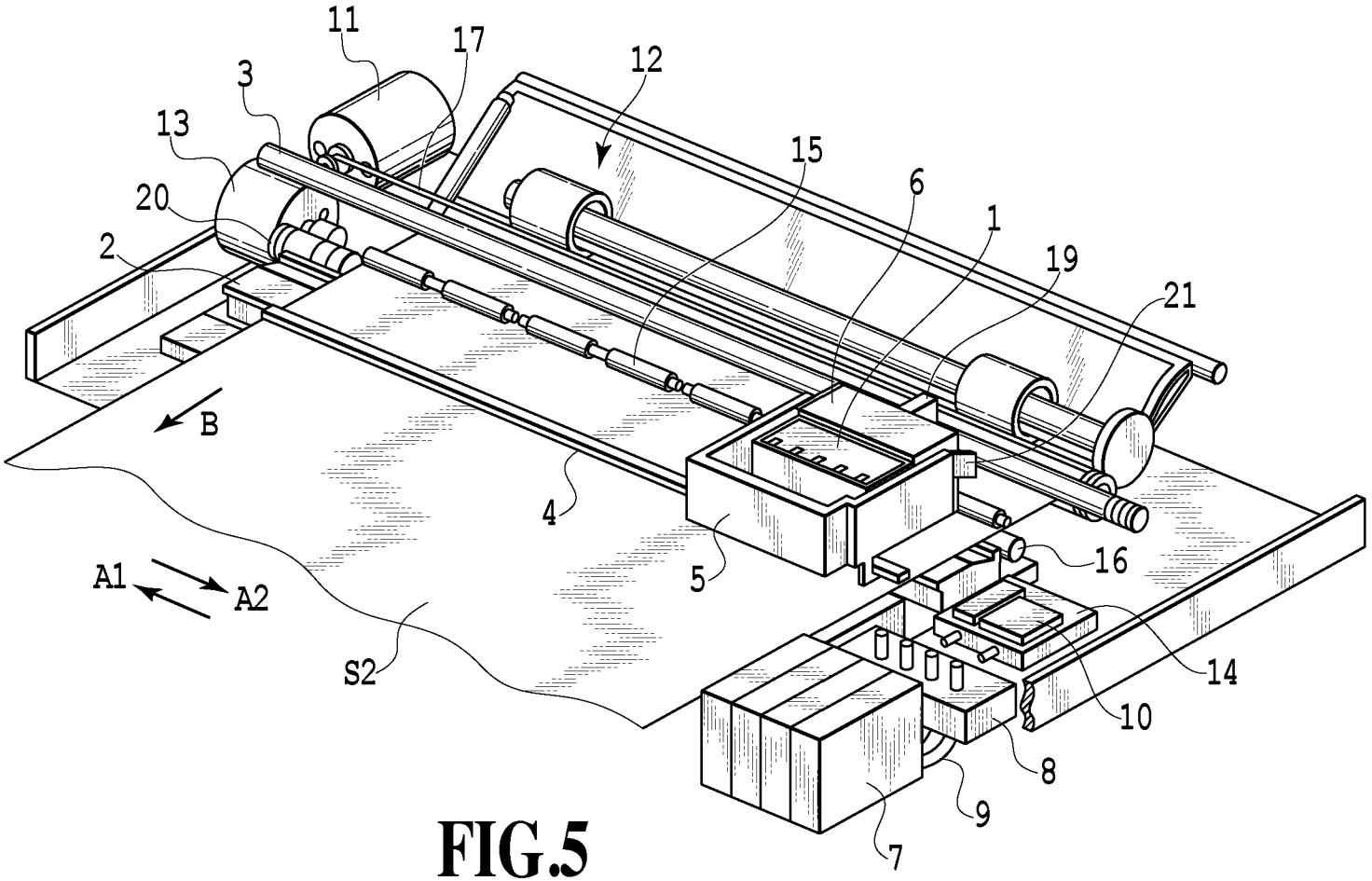
FIG. 5 is a perspective view of an inkjet printing apparatus applied in one embodiment of this invention.

FIG. 4 is an external perspective view of an inkjet printing apparatus used in this embodiment. FIG. 5 is a perspective view showing the inside of the inkjet printing apparatus.

In this embodiment, a print medium is fed from a paper tray 12 in a direction of arrow of FIG. 4, after which the print medium is printed with an image while being advanced intermittently. The print medium formed with the image is discharged onto a discharge tray 23.

In FIG. 5, the print head 1 mounted on a carriage 5 ejects ink from nozzles while traveling along a guide rail 4 in the direction of arrows A1 and A2 along with the carriage 5 to form an image on a print medium S2. The print head 1 has a plurality of nozzle groups, each assigned to a different color ink, and a nozzle group assigned to the image quality improvement liquid. For example, it has nine nozzle groups that eject 10 color inks described later—cyan (C), magenta (M), yellow (Y), black1 (K1), black2 (K2), light cyan (LC), light magenta (LM), red (R), green (G) and gray (Gray), and a nozzle group for ejecting the image quality improvement liquid (CL). These color inks and the image quality improvement liquid are stored in ink tanks (not shown), from which they are supplied to the print head 1.

In this embodiment, the ink tanks and the print head 1 are formed integral to construct a head cartridge 6 which is mounted on the carriage 5. A drive force of a carriage motor 11 is transmitted through a timing belt 17 to the carriage 5 to cause it to reciprocate along a guide shaft 3 and the guide rail 4 in the direction of arrows A1, A2 (main scan direction). The position of the reciprocating carriage 5 is detected by the encoder sensor 21, installed in the carriage 5, reading a linear scale 19 extending in a direction of movement of the carriage.

In printing the print medium, first the print medium S2 is fed from the paper tray 12 to a position where it is pinched between a conveyance roller 16 and pinch rollers 15. Then, a conveyance motor 13 drives the conveyance roller 16 through a linear wheel 20 to move the print medium S2 to a platen 2. Next, when the carriage 5 performs one printing scan in the A1 direction, the print medium S2 is advanced a predetermined distance in the direction of arrow B by the conveyance roller. Then, the carriage 5 is scanned in the A2 direction to print the print medium S2. At the home position, there are provided a head cap 10 and a recovery unit 14, as shown in FIG. 5, to execute an intermittent recovery operation on the print head 1 as required.

When the printing operation on one sheet of print medium is finished by repetitively executing the aforementioned steps, the print medium S2 is discharged.

Figure 6:
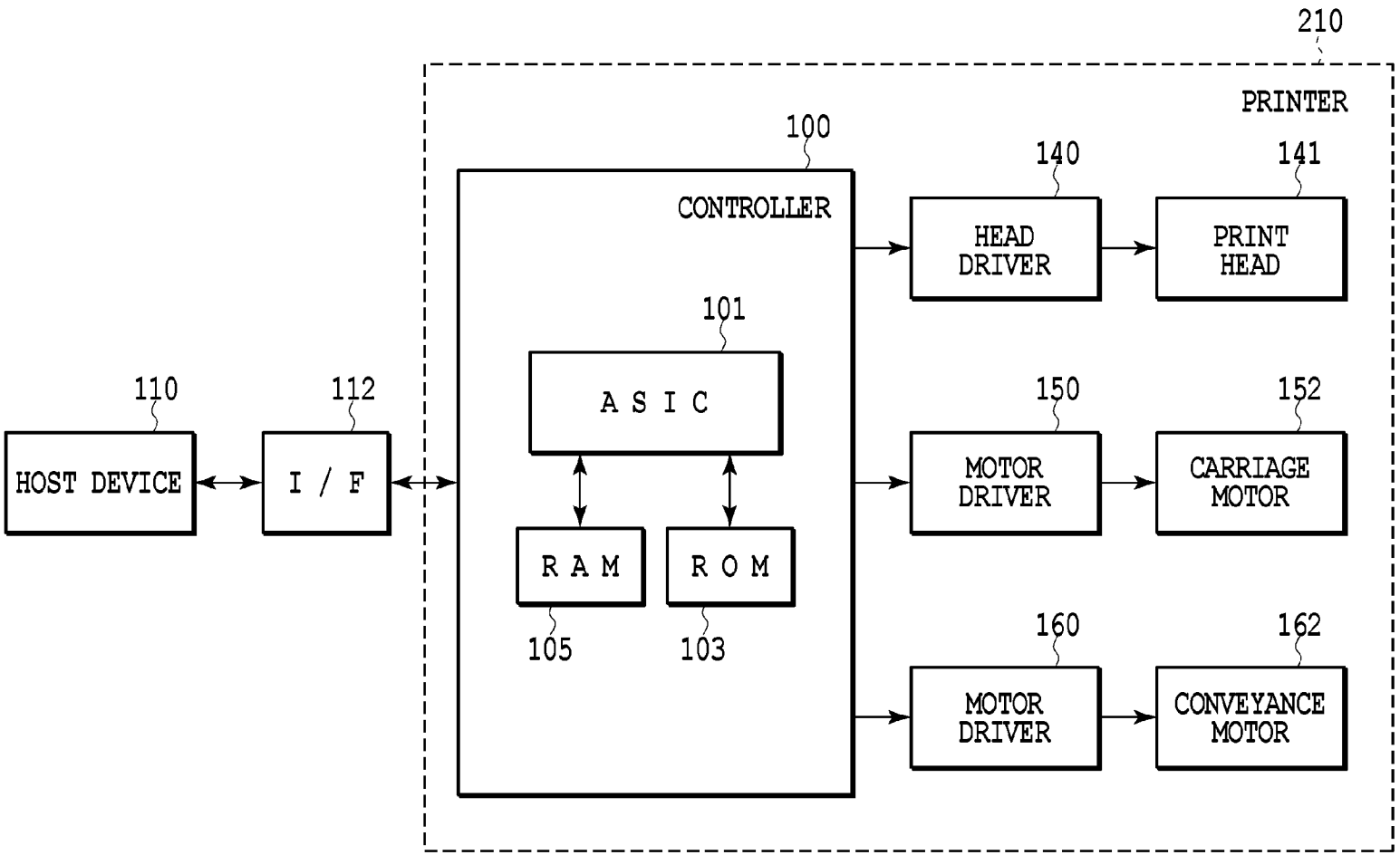
FIG. 6 is a block diagram showing an interior of the inkjet printing apparatus.

FIG. 6 is a block diagram showing a control configuration of the inkjet printing apparatus of this embodiment. A controller 100 is a main control unit with functions as a computation means, a decision control unit and a general control unit. For example, it has an ASIC 101, a ROM 103 and a RAM 105 in a microcomputer structure. The ROM 103 stores a dot positioning pattern, a mask pattern and other fixed data. The RAM 105 has an area in which to develop print data and a work area. The ASIC 101 reads a program from the ROM 103 and, based on the input image data, executes a series of operations to generate binary print data to be printed on the print medium. More specifically, from information on the volume of ink to be ejected (ink ejection volume), a mask pattern is selected to divide the image data and generate print data.

A host device 110 is a source of image data described later. The host device may be in the form of a computer that generates and processes data such as images to be printed, or a reader unit for reading images. Image data, commands and status signals output from the host device 110 are transferred to and from the controller 100 via interface (I/F) 112.

A head driver 140 drives the print head 1 according to the print data. A motor driver 150 drives the carriage motor 11, and a motor driver 160 drives the conveyance motor 13.

Next, explanations will be given as to color inks (referred to simply as inks) containing pigment colorants that are used in the inkjet printing apparatus of this embodiment. First, let us explained about components making up the inks.

(Ink Composition)

<Aqueous Medium>

The inks of this invention preferably use aqueous medium containing water or a water-soluble organic solvent. The content of the water-soluble organic solvent in ink (mass %) is preferably in the range of between 3.0 mass % and 5 mass %. Further, the water content in ink (mass %) is preferably in the range of between 50.0 mass % and 95.0 mass % with respect to the total ink mass.

More specifically, what may be used as the water-soluble organic solvent include: alkyl alcohols with 1 to 6 carbon atoms, such as methanol, ethanol, propanol, propanediol, butanol, butanediol, pentanol, pentanediol, hexanol and hexanediol; amides, such as dimethylformamide and dimethylacetamide; ketones or ketoalcohols, such as acetone and diacetonealcohol; ethers, such as tetrahydrofurane and dioxane; polyalkylene glycols with average molar masses of 200, 300, 400, 600 and 1,000, such as polyethylene glycol and polypropylene glycol; alkylene glycols with 2 to 6 carbon atoms, such as ethylene glycol, propylene glycol, butylene glycol, triethylene glycol, 1,2,6-hexanetriole, thiodiglycol, hexyleneglycol and diethylene glycol; lower alkyl ether acetate such as polyethylene glycol monomethyl ether acetate; glycerines; lower alkyl ethers of polyvalent alcohols, such as ethylene glycol monomethyl (or ethyl)ether, diethylene glycol methyl (or ethyl)ether, triethylene glycol monomethyl (or ethyl)ether; and N-methyl-2-pyrrolidone, 2-pyrrolidone, 1,3-dimethyl-2-imidazolidinone. Deionized water (ion-exchanged water) should preferably be used.

<Pigments>

Preferred pigments include carbon black and organic pigments. The pigment content (mass %) in ink is preferably in the range of between 0.1 mass % and 15.0 mass % with respect to the entire ink mass.

Black inks preferably use as pigments carbon blacks such as furnace black, lamp black, acetylene black and channel black. More specifically, the following commercially available products may be used: Raven 7000, 5750, 5250, 5000 Ultra, 3500, 2000, 1250, 1200, 1190 Ultra-II, 1170 and 1255 (from Columbian Chemicals Co.); Black Pearls L, Regal 330R, 400R, 660R, Mogul L, Monarch 700, 800, 880, 900, 1000, 1100, 1300, 1400, 2000, and Vulcan XC-72R (from Cabot Corporation); Color Black FW1, FW2, FW2V, FW18, FW200, S150, S160, 5170, Printex 35, U, V, 140U, 140V, and Special Black 6, 5, 4A, 4 (from Degussa); and No. 25, No. 33, No. 40, No. 47, No. 52, No. 900, No. 2300, MCF-88, MA600, MA7, MA8 and MA100 (from Mitsubishi Chemicals Corp.). It is also possible to use carbon black newly prepared for this invention. It is noted, however, that this invention is not limited to these carbon blacks but may use any conventionally available carbon black. In addition to carbon blacks, magnetic particles, such as magnetite and ferrite, and titan black may also be used as pigments.

As organic pigments, the following materials may be used: water-insoluble azo pigments such as Toluidine Red, Toluidine Maroon, Hansa Yellow, Benzidine Yellow and Pyrazolone Red; water-soluble azo pigments such as lithol Red, Helio-Bordeaux, Pigment Scarlet and Permanent Red 2B; derivatives of vat dye type pigments such as Alizarin, Indanthrone and Thioindigo Maroon; Phthalocyanine pigments such as Phthalocyanine Blue and Phthalocyanine Green; Quinacridone Pigments such as quinacridone red and quinacridone magenta; Perylene Pigments such as Perylene Red and Perylene Scarlet; Isoindolinone Pigments such as Isoindolinone Yellow and Isoindolinone Orange; Imidazolone Pigments such as Benzimidazolone Yellow, Benzimidazolone Orange and Benzimidazolone Red; Pyranthrone Pigments such as Pyranthrone Red and Pyranthrone Orange; Indigo pigments, condensed azo pigments, Thioindigo pigments and Diketopyrrolopyrrole pigments; and Flavanthrone Yellow, Acrylamide Yellow, Quinophthalone Yellow, Nickel Azo Yellow, Copper Azomethine Yellow, Perinone Orange, Anthrone Orange, Dianthraquinonyl Red and Dioxazine Violet. It is noted that this invention is not limited to these pigments.

Organic pigments that may be used, when indicated in color index (C.I.) number, include: C.I. Pigment Yellow 12, 13, 14, 17, 20, 24, 74, 83, 86, 93, 97, 109, 110, 117, 120, 125, 128, 137, 138, 147, 148, 150, 151, 153, 154, 166, 168, 180, 185; C.I. Pigment Orange 16, 36, 43, 51, 55, 59, 61, 71; C.I. Pigment Red 9, 48, 49, 52, 53, 57, 97, 122, 123, 149, 168, 175, 176, 180, 192, 215, 216, 217, 220, 223, 224, 226, 227, 228, 238, 240, 254, 255, 272; C.I. Pigment Violet 19, 23, 29, 30, 37, 40, 50; C.I. Pigment Blue 15, 15:1, 15:3, 15:4, 15:6, 22, 60 64; C.I. Pigment Green 7, 36; and C.I. Pigment Brown 23, 25, 26. This invention is of course not limited to these pigments.

<Dispersants>

The dispersants to disperse the pigments listed above in an aqueous medium can be chosen from any of water-soluble resins. Particularly preferable are those with the weight-average molecular weight of between 1,000 and 30,000 or more preferably between 3,000 and 15,000. The content of the dispersant in ink (mass %) is preferably between 0.1 mass % and 5.0 mass % with the total mass of ink taken as a reference.

Dispersants that can be used, for example, include: styrene, vinylnaphthalene, aliphatic alcohol ester of unsaturated $\alpha,\beta$-ethylene carboxylic acid, acrylic acid, maleic acid, itaconic acid, fumaric acid, vinyl acetate, vinylpyrrolidone, acrylamide, or polymers with these derivatives as monomers. Of the monomers making up the polymers, one or more of them preferably are hydrophilic monomers. Block copolymers, random copolymers, graft copolymers or salts of these polymers may be used. It is also possible to use natural resins such as rosin, shellac and starch. These resins are preferably soluble in a water solution of bases, i.e., alkali-soluble.

<Surfactants>

To adjust the surface tension of inks of an ink set, it is preferred to use surfactants, such as anionic surfactant, nonionic surfactant and amphoteric surfactant. More specifically, polyoxyethylene alkyl ether, polyoxyethylene alkyl phenols, acetylene glycol compounds and acetylene glycol ethylene oxide additives may be used.

<Other Components>

The inks of the ink set may contain, in addition to the aforementioned components, moisturizing solid components such as urea, urea derivatives, trimethylolpropane and trimethylolethane for keeping ink moist. The content of the moisturizing solid component in ink (mass %) is preferably between 0.1 mass % and 20.0 and more preferably between 3.0 mass % and 10.0 mass % with the total ink mass taken as a reference. Further, the inks of the ink set may also contain additives such as pH regulators, rust preventives, preservatives, mildew-proofing agents, antioxidants, reduction prevention agents and evaporation promotion agents.

Next, the inks used in this embodiment will be explained in more detail. This invention is not limited to the following embodiments as long as it does not depart from the scope of this invention. It is noted that "parts" and "%" in the following description are based on the mass reference unless otherwise specifically stated.

<Preparation of Pigment Dispersant Liquids 1-6>

Pigment dispersant liquids 1-6 were prepared in the following procedure. In the descriptions that follow, dispersants refer to aqueous solutions made by neutralizing styrene-acrylic acid copolymer having an acid number of 200 and a weight-average molecular weight of 10,000 with a 10 mass % sodium hydroxide aqueous solution.

Preparation of Pigment Dispersant Liquid 1 Containing C.I. Pigment Red 122

Ten parts of pigment (C.I. Pigment Red 122), 20 parts of dispersant and 70 parts of ion-exchange water were normal and dispersed in a batch type vertical sand mill for three hours. Then, the normal substances were centrifuged to remove coarse particles. Further, they were filtered under pressure through a cellulose acetate filter (of Advantec make) with a pore size of 3.0 μm to obtain a pigment dispersant liquid 1 with a pigment concentration of 10 mass %.

Preparation of Pigment Dispersant Liquid 2 Containing C.I. Pigment Blue 15:3

Ten parts of pigment (C.I. Pigment Blue 15:3), 20 parts of dispersant and 70 parts of ion-exchange water were normal and dispersed in a batch type vertical sand mill for five hours. Then, the normal substances were centrifuged to remove coarse particles. Further, they were filtered under pressure through a cellulose acetate filter (of Advantec make) with a pore size of 3.0 μm to obtain a pigment dispersant liquid 2 with a pigment concentration of 10 mass %.

Preparation of Pigment Dispersant Liquid 3 Containing C.I. Pigment Yellow 74

Ten parts of pigment (C.I. Pigment Yellow 74), 20 parts of dispersant and 70 parts of ion-exchange water were normal and dispersed in a batch type vertical sand mill for one hour. Then, the normal substances were centrifuged to remove coarse particles. Further, they were filtered under pressure through a cellulose acetate filter (of Advantec make) with a pore size of 3.0 μm to obtain a pigment dispersant liquid 3 with a pigment concentration of 10 mass %.

Preparation of Pigment Dispersant Liquid 4 Containing C.I. Pigment Black 7

Ten parts of carbon black pigment (C.I. Pigment Black 7), 20 parts of dispersant and 70 parts of ion-exchange water were normal and dispersed in a batch type vertical sand mill for 3 hours. The circumferential speed for dispersion operation was set at two times that for preparing the pigment dispersant liquid 1. Then, the normal substances were centrifuged to remove coarse particles. Further, they were filtered under pressure through a cellulose acetate filter (of Advantec make) with a pore size of 3.0 μm to obtain a pigment dispersant liquid 4 with a pigment concentration of 10 mass %.

Preparation of Pigment Dispersant Liquid 5 Containing C.I. Pigment Red 149

Ten parts of pigment (C.I. Pigment Red 149), 20 parts of dispersant and 70 parts of ion-exchange water were normal and dispersed in a batch type vertical sand mill for 3 hours. Then, the normal substances were centrifuged to remove coarse particles. Further, they were filtered under pressure through a cellulose acetate filter (of Advantec make) with a pore size of 3.0 μm to obtain a pigment dispersant liquid 5 with a pigment concentration of 10 mass %.

Preparation of Pigment Dispersant Liquid 6 Containing C.I. Pigment Green 7

Ten parts of pigment (C.I. Pigment Green 7), 20 parts of dispersant and 70 parts of ion-exchange water were normal and dispersed in a batch type vertical sand mill for 3 hours. Then, the normal substances were centrifuged to remove coarse particles. Further, they were filtered under pressure through a cellulose acetate filter (of Advantec make) with a pore size of 3.0 μm to obtain a pigment dispersant liquid 6 with a pigment concentration of 10 mass %.

(Preparation of Inks)

Components shown in FIG. 7 are normal and thoroughly stirred before being filtered under pressure through a cellulose acetate filter (of Advantec make) with a pore size of 0.8 μm to prepare inks 1-11.

Next, the image quality improvement liquid used in this embodiment will be explained.

(Preparation of Image Quality Improvement Liquid)

Using styrene (St)-acrylic acid (AA) copolymer A (St/AA=70/30 (mass %), molar mass: 10500 and actually measured acid number: 203) synthesized by a solution polymerization using a radical initiator, a liquid compound A of the following composition is produced. Potassium hydroxide is used as a basic substance and its amount to be added is adjusted so that pH of the liquid compound is 8.0.

| | |
|---|---|
| Styrene-acrylic acid copolymer A | 2 parts |
| Glycerin | 7 parts |
| Diethylene glycol | 5 parts |
| Water | 86 parts |

The image quality improvement liquid obtained as a result of the above process is intended to control at least the glossiness. As long as the similar effect is produced, any image quality improvement liquid is not limited by the example.

Next, the image processing in this embodiment will be described.

Figure 8:
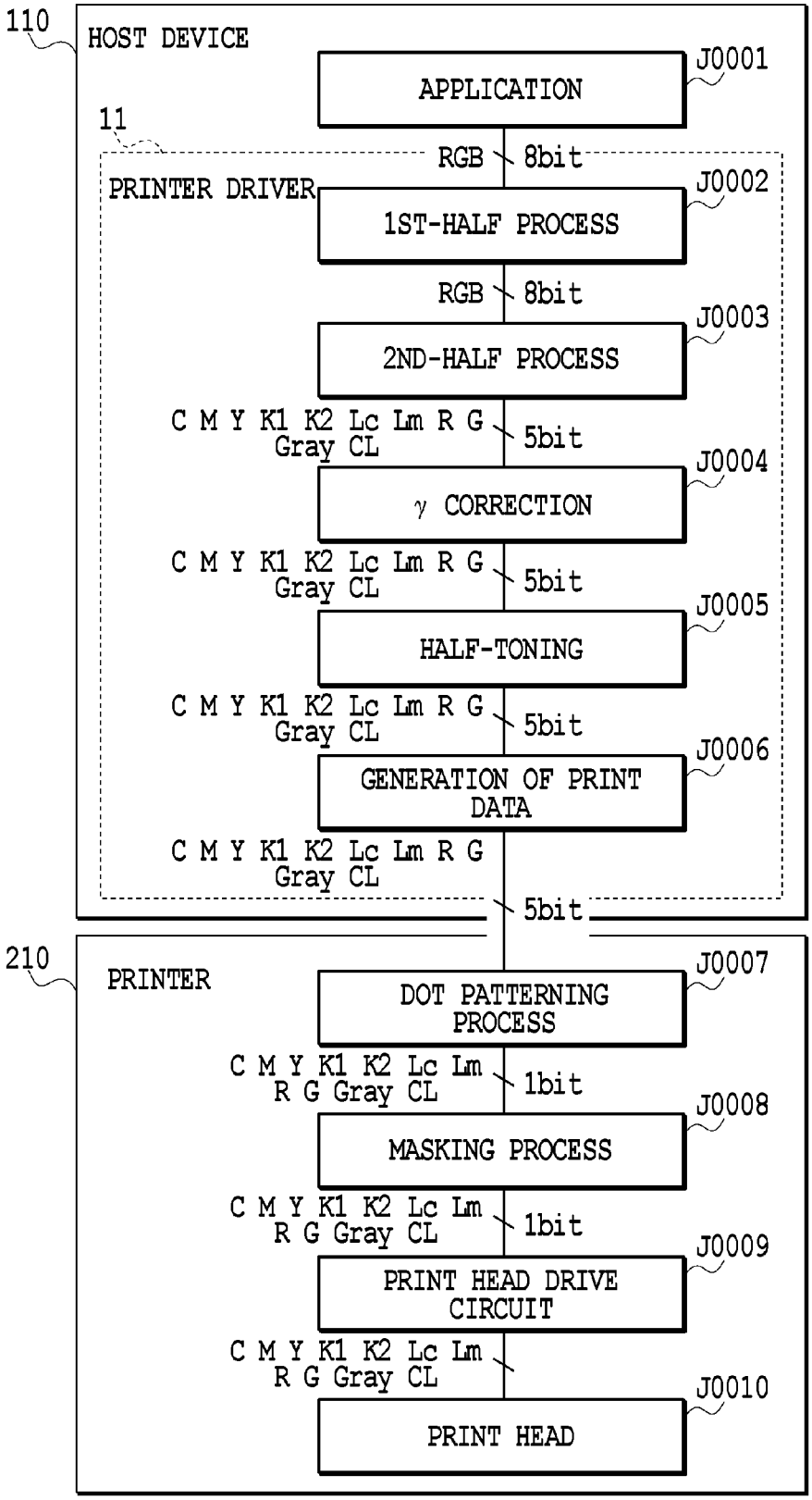
FIG. 8 is a block diagram showing a flow of image data conversion processing in the embodiment.

FIG. 8 is a block diagram showing a flow of an image data conversion process in this embodiment that converts 8-bit (256-gradation) image data for each RGB color into 1-bit data for each ink color before outputting to the print head. This printing system comprises a host device 110 and a printer 210.

The host device 110 is, for example, a personal computer comprising an application J0001 and a printer driver 11 for the printing apparatus of this embodiment. The application J0001, based on information specified by the user on a UI screen on a monitor of the host device 110, executes an operation of generating image data to be transferred to the printer driver 11 described later and also an operation of setting print control information.

Figure 9:
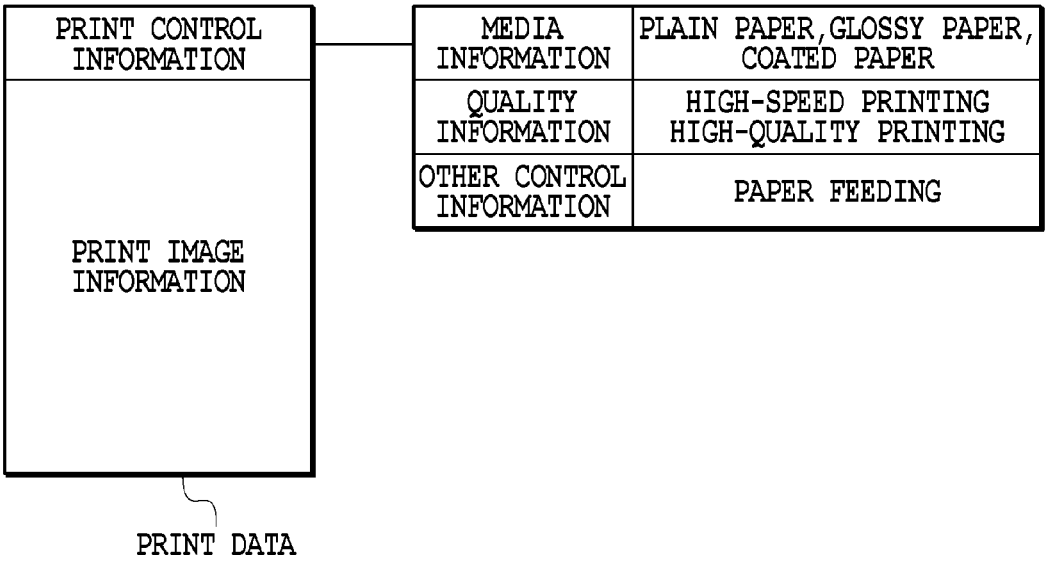
FIG. 9 shows image data and print control information to be transferred from a printer driver to the printer in the embodiment.

FIG. 9 shows an example structure of the image data and print control data described above. The print control data consists of "print medium information", "print quality information" and "other control information" such as paper feeding method. The print medium information describes the kind of print medium on which images are to be printed, and specifies one kind from among plain paper, glossy paper, post card and printable disk. The print quality information describes the quality of printed image and specifies one from among "clear", "standard" and "fast".

The image data and the print control data processed by the application are transferred to the printer driver 11 before starting the printing operation. The printer driver 11 has a precedent process J0002, a subsequent process J0003, a γ correction process J0004, a quantization process J0005, and print data generation process J0006 to execute. These processing will be briefly explained.

The precedent process J0002 maps a color gamut. This process performs data conversion of a color space represented by image data (R, G, B) of sRGB standard into another color space represented by the printer. More specifically, 8-bit 256-gradation data for each RGB color is converted into 8-bit RGB data (RGB value) in a different color space by using a three-dimensional lookup table (LUT).

The subsequent process J0003, based on the three-dimensional LUT for the subsequent process, converts the RGB data mapped in the above color space into 8-bit color separation data, a combination of inks that reproduces the color represented by this data. Since in this embodiment 10 color inks—C, M, Y, K1, K2, LC, LM, R, G and Gray—are used, the subsequent process J0003 converts the RGB data into color separation data, a combination of these ink colors. Here, as in the precedent process, the color conversion is performed using an interpolation operation along with the three-dimensional LUT. Further, in the process of combining the ink colors, 8-bit color separation data CL for the image quality improvement liquid that reproduces a desired gloss level is also generated.

The γ correction process J0004 performs a density value (gradation value) conversion for each color on the color separation data determined by the subsequent process J0003. More specifically, the conversion is done to match the color separation data linearly to the printer's gradation characteristics by using the one-dimensional LUT.

The quantization process J0005 performs the quantization process to convert the γ-corrected 8-bit color separation data into 5-bit data for each color. In this embodiment, an error diffusion method is used to convert the 8-bit 256-gradation data into 5-bit 17-gradation value data. The 5-bit image data functions as index indicating a dot positioning pattern in the process of patterning the dot positions in the printer. The quantized 17-gradation data represents one of gradation values 0-16.

The print data generation process J0006 generates the aforementioned print control data and the 5-bit print data generated by the quantization process J0005. The print data thus generated is supplied to the printer 210.

When the print data is fed from the host device 110 to the printer 210, the printer performs a dot patterning process J0007 and a masking process J0008 on the print data received.

Figure 10:
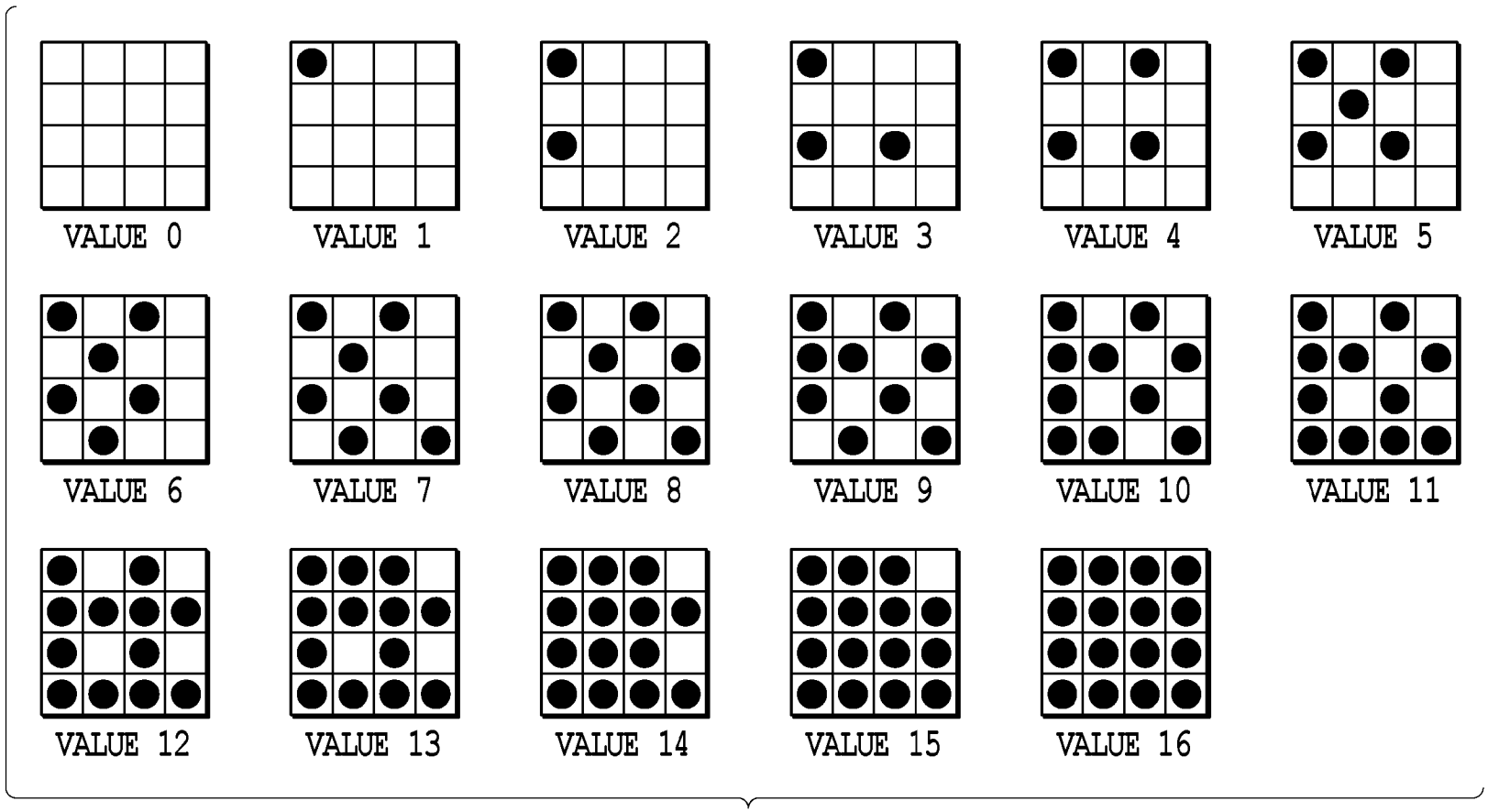
FIG. 10 shows a dot patterning process in the embodiment.

The dot patterning process J0007 performs a binarization by converting the received 17-gradation value data into a dot positioning pattern, providing binary data on whether or not the printer should eject ink at each position. The dot positioning pattern of 17-gradation value used in this embodiment is shown in FIG. 10. In the dot positioning pattern of FIG. 10, among the areas making up one pixel, those marked with a solid black circle represent areas where ink dots are formed. Blank areas represents areas where no dot is formed. The dot patterning process J0007 develops a dot positioning pattern corresponding to the gradation value (0-16) of a pixel which is represented by 5-bit data output from the quantization process J0005. This defines whether or not a plurality of individual unit areas in each pixel should be printed with an ink dot (i.e., whether ink needs to be ejected onto the individual areas). That is, the 5-bit input data for each pixel representing one of gradation values 0-16 is converted into a dot pattern for the pixel that consists of 4×4 areas, each assigned 1-bit binary data "1" or "0", "1" indicating that a dot needs to be formed in the associated area, "0" indicating no dot needs to be formed there.

In the masking process J0008, a plurality of mask patterns that are complementary to each other are used to convert the dot position data for each color determined by the dot patterning process J0007 into dot position data attached with print scan timing information. This masking process will be detailed later. With this masking process, print data for each print scan in a multipass printing is generated for each color C, M, Y, K1, K2, LC, LM, R, G, Gray. The multipass printing refers to a printing method that completes an image on a certain print area by performing a plurality of scans over the same print area.

The generated print data is supplied to a print head drive circuit J0009 at an appropriate timing in a plurality of print scans executed in a multipass printing. The print data fed to the print head drive circuit J0009 is converted into pulses for the print head 1 of each color which ejects ink at a predetermined timing. In this way, the ink ejection is done according to the print data to print an image on a print medium.

Figure 11:
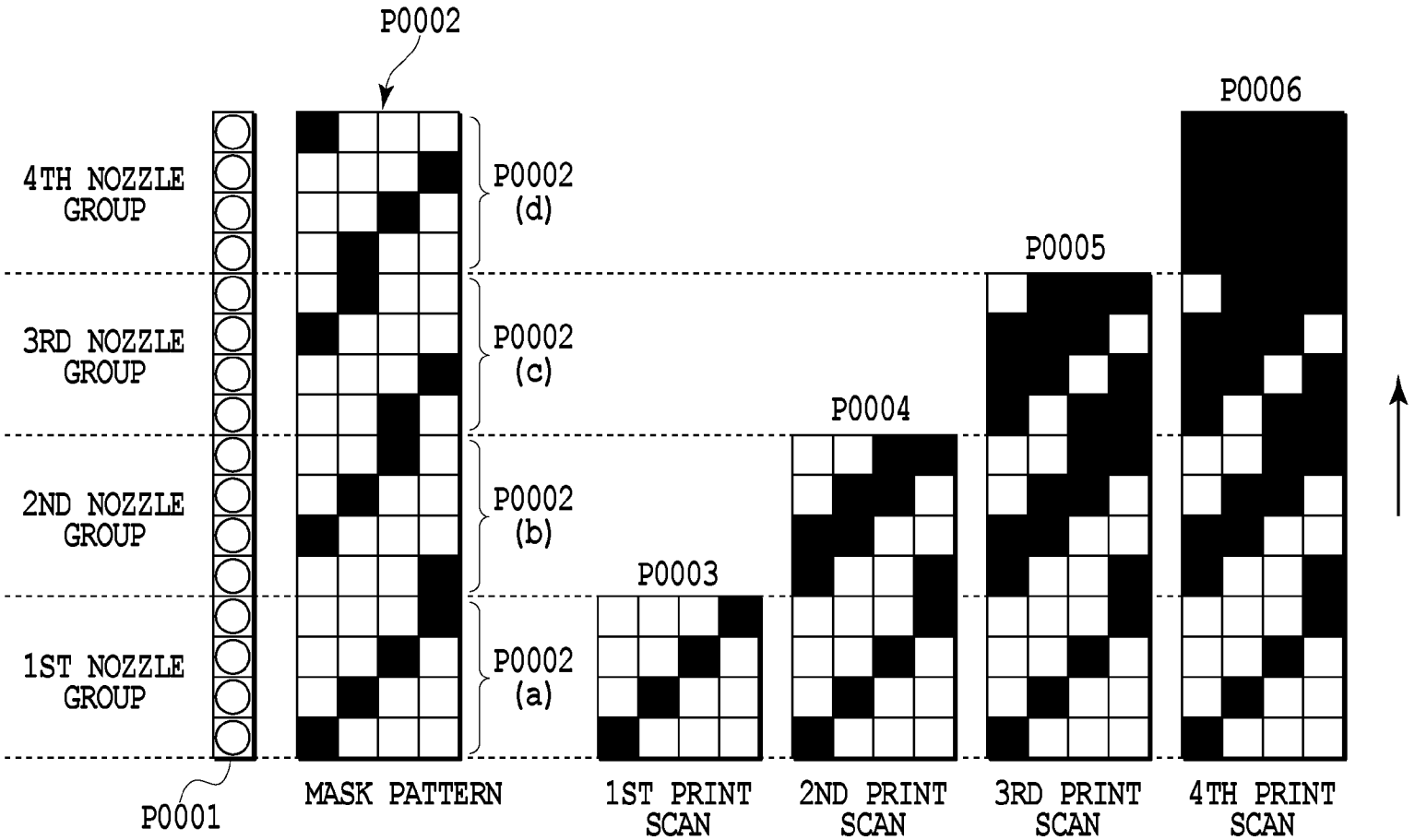
FIG. 11 shows how a multipass printing and mask patterns work.

The multipass printing refers to a printing method that completes an image on a particular print area (unit area) by performing a plurality of scans of the print head over that print area. FIG. 11 schematically shows how the multipass printing is performed. The print head 1 used in this embodiment actually has 768 nozzles but, for simplicity, is described to have only 16 nozzles P0001 and complete an image with four print scans.

The nozzles P0001 are divided into four nozzle groups 1-4, each of which includes four nozzles. The multipass printing, that performs printing on a unit area with a plurality of scans, uses masks as a means to divide the image data to be printed into a plurality of data blocks. A mask P0002 has four mask patterns P0002(*a*)-P0002(*d*), defining print-permitted areas in the respective first to fourth nozzle group.

In the mask pattern, black square areas represent areas that are permitted to form a dot on a print medium while blank square areas represent areas that are not permitted to form a dot. The first to fourth mask pattern P0002(*a*)-P0002(*d*) are complementary to one another and, when overlapped together, complete the printing in a area of 4×4=16 areas. The patterns shown at P0003-P0006 shows the process of an image being formed by repeating the print scan overlappingly.

Each time the single stroke of print scan is done, the print medium is intermittently advanced a distance equal to the width of one nozzle group (in this example, four nozzles) in a direction of arrow. The same print area (corresponding to the width of each nozzle group) on the print medium is fully printed by four print scans. This mask pattern and the binary image data produced by the dot positioning pattern are ANDed to determine the binary print data to be printed by individual printing passes.

In the mask pattern, a percentage of the print-permitted areas in each print scan is defined by duty (%). That is, with the area corresponding to the 16 areas taken as 100%, the duty in each print scan represents a percentage of the number of print-permitted areas with respect to the 16 areas. In the mask patterns P0002(*a*)-P0002(*d*), the print-permitted areas in each print scan are evenly distributed and the duty of each print scan is 25%.

(First Embodiment)

Figure 12:
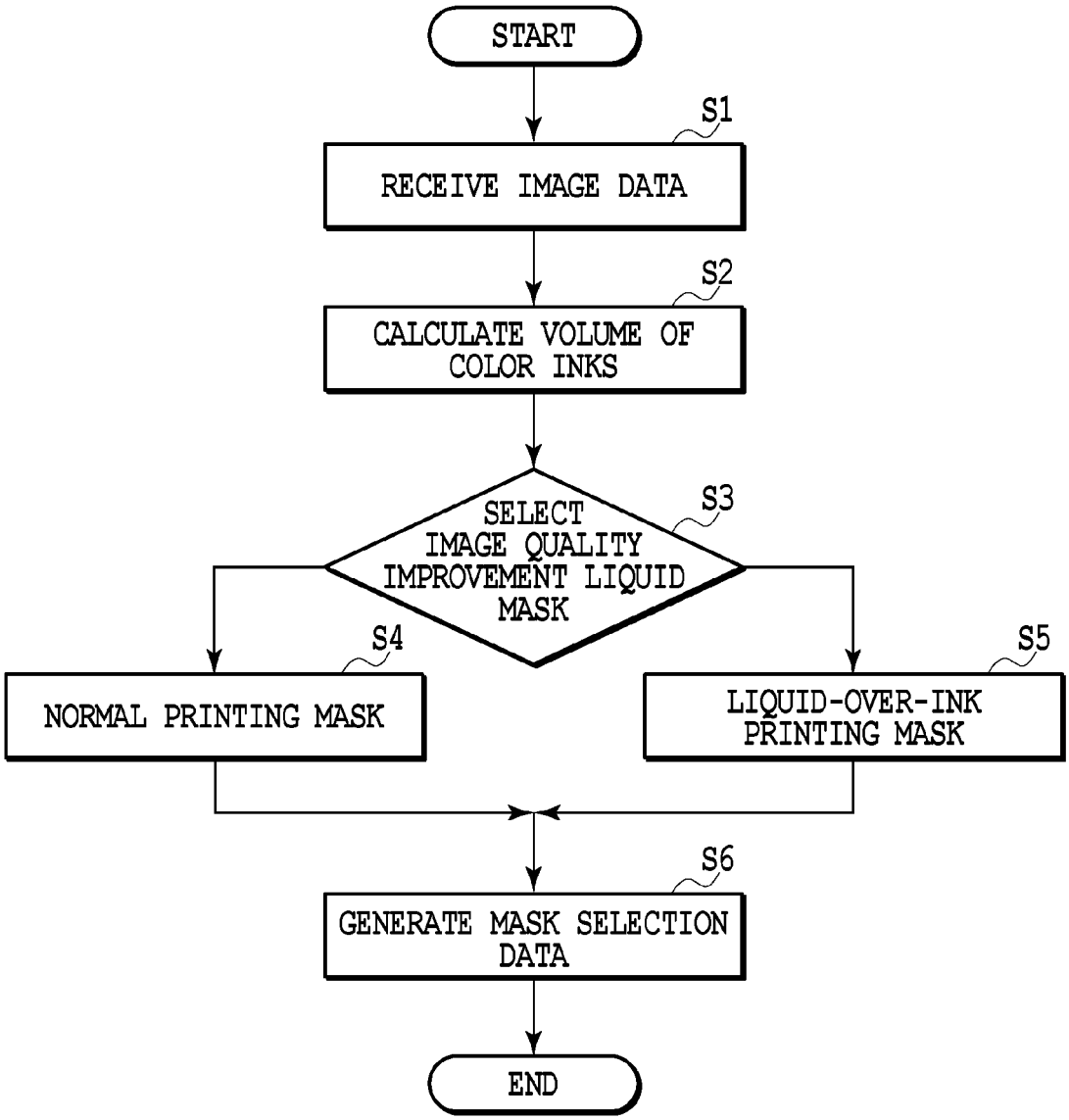
FIG. 12 is a flow chart showing a sequence of steps in selecting a mask pattern for the image quality improvement liquid in first embodiment.

FIG. 12 is a flow chart showing a flow of processing that selects a mask pattern for the image quality improvement liquid according to the volume of the color inks applied to a predetermined area based on the image data. In the diagram, step S1 receives print data for each color ink in the predetermined area. Step S2 calculates the volume of color inks to be ejected. Further, steps S3-S5 determine the kind of image quality improvement liquid mask to be used in the print area of the print data. Step S6 generates data for selecting an image quality improvement liquid mask to be used (mask selection data).

At step S1, the print data in a unit area uses the 4×4 binary areas (600 dpi×600 dpi) of FIG. 10, which constitutes one pixel area, as a unit area. At step S2, the volume of inks ejected onto the unit area actually refers to a sum of volumes of different color inks applied, calculated based on the print data generated by the print data generation process J0006 of FIG. 8 (hereinafter referred to as a total applied ink volume. The applied ink volume is taken to be 100% when dots are formed in all of the 16 areas making up the unit pixel area. When eight areas are printed with dots, the applied ink volume is taken as 50%. The maximum total applied ink volume is 100%.

Step S3 determines the mask to be used in the unit area by referring to the kind of image quality improvement liquid mask, shown in FIG. 14, that matches the total applied ink volume. As shown in the figure, in highlight areas where the applied ink volume in the unit area is less than 15%, a normal printing mask is chosen for the image quality improvement liquid (step S4). This raises the gloss level by the first effect (1) described earlier. In half-tone areas where the applied ink volume is between 15% and 50% (less than a predetermined volume), the normal printing mask is selected (step 4). This lowers the gloss level and the image clarity by the second effect (2) and third effect (3). In shadow areas where the applied ink volume is equal to or more than 50% (the predetermined volume), a liquid-over-ink printing mask is selected for image quality improvement liquid (step S5). This lowers the gloss level by the fourth effect (4).

Step S6 produces the mask selection data, based on which the masking process J0008 of FIG. 8 performs the mask operation using a preset normal printing mask pattern or a liquid-over-ink printing mask pattern.

Next, features of two masks used in steps S4 and S5 will be explained by referring to FIGS. 13A-13D. FIG. 13A shows a normal printing mask for image quality improvement liquid (first mask) and a print duty (print ratio) defined by the first mask. FIG. 13B shows a liquid-over-ink printing mask for image quality improvement liquid (second mask) and a print duty (print ratio) defined by the second mask. Further, FIG. 13C shows a color ink mask and a print ratio defined by this mask. The values in print-permitted areas represent at which print scan the areas are printed. For example, "1" in mask M1 represents a print-permitted area to be printed in the first scan. Similarly "2" represents an area to be printed in the second scan; "3" an area to be printed in the third scan; and "4" an area to be printed in the fourth scan. That is, although the masks M1-M3 shown in FIGS. 13A-13C are each comprised of four mask patterns (in FIG. 11, P0002(*a*)-(*d*)), FIG. 13 shows these four mask patterns overlapped together.

The liquid-over-ink printing mask for image quality improvement liquid (simply referred to as a liquid-over-ink printing mask) M2 has a higher duty in the latter half of the four print scans than the normal printing mask for image quality improvement liquid (simply referred to as a normal printing mask) M1. That is, the normal printing mask (first mask) M1 of FIG. 13A has four print-permitted areas in each of the first to fourth print scan. The liquid-over-ink printing mask M2 of FIG. 13B, on the other hand, has one print-permitted area in the 1st print scan, three print-permitted areas in the 2nd print scan, five areas in the 3rd print scan and seven areas in the 4th print scan. Compared with the liquid-over-ink printing mask M2, the normal printing mask (first mask) M1 has fewer print-permitted areas (i.e., a lower rate at which the image quality improvement liquid is applied) in the latter two scans.

FIG. 13D shows how the color inks and the image quality improvement liquid are overlapped. As for marks in the areas, ○ represents areas in which the image quality improvement liquid is applied in a print scan following that of the color inks and therefore applied over the color inks. Δ represents areas in which the image quality improvement liquid is applied in the same print scan that the color inks are printed and therefore not necessarily applied over the color inks. x represents areas in which the image quality improvement liquid is applied in a print scan preceding that of the color inks and therefore applied beneath the color inks.

As shown in FIG. 13D, the use of the liquid-over-ink printing mask M2 results in the number of those print-permitted areas, in which the image quality improvement liquid is applied over the color inks (marked with ○ in FIG. 13D), being relatively higher than that when the normal printing mask M1 is used. So, the liquid-over-ink printing mask M2 can efficiently control the gloss level while minimizing the degradation value of image clarity. By combining these masks, it is possible to alleviate the occurrence of the glossiness unevenness of a printed image, thus producing an image with uniform glossiness. Especially, the differences in gloss level and image clarity between highlight areas and shadow areas are reduced, improving the glossiness uniformity in the printed image.

While this embodiment groups the applied ink volume, that serves as a criterion for mask selection, into three ranges, as shown in FIG. 14, the mask is selected from two kinds of mask—the normal printing mask (first mask) and the liquid-over-ink printing mask (second mask). This invention is not limited to this method. For example, even in half-tone areas, a mask that has more print-permitted areas in the second-half scans than in the first-half scans may be used. It is also possible to arrange the mask so that the difference in the number of print-permitted areas between the second-half scans and the first-half scans is greater in the half-tone areas than in the shadow areas. Further, in highlight areas also, this embodiment is not limited to the arrangement that uses the normal printing mask. It is possible to use either a print-in-first-half-scan mask (having a greater number of print-permitted areas in the first-half scans than in the second-half scans) or a print-in-second-half-scan mask. In either case, by arranging the masks such that, as the applied ink volume in the highlight areas, half-tone areas and shadow areas increases, the difference in the number of print-permitted areas between the second-half scans and the first-half scans also increases, the similar effects to those described in this embodiment can be produced. Further, this invention controls the overlapping of the image quality improvement liquid over the color inks to bring the gloss level and the image clarity that change according to the applied color ink volume closer to desired levels. The applied ink volume may be grouped into a greater or smaller number of ranges than three.

The multipass printing, too, is not limited to the four passes and the effects of this embodiment can be produced without being restricted by the number of passes. While a plurality of print passes in the multipass printing have been described to be complementary to one another, they do not have to have a complementary relation among them. The number of dots in each pass may be increased or decreased.

(Second Embodiment)

Figure 15A:
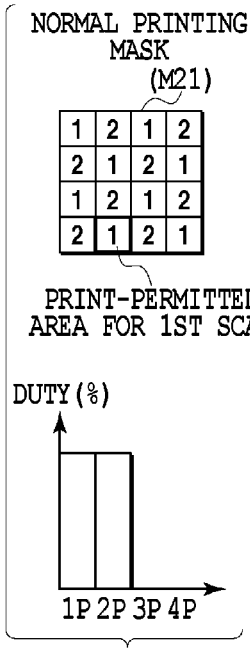
FIGS. 15A-15D show how mask patterns work in a second embodiment.
Figure 15B:
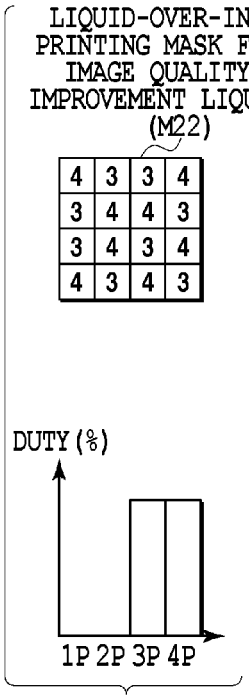
Figure 15C:
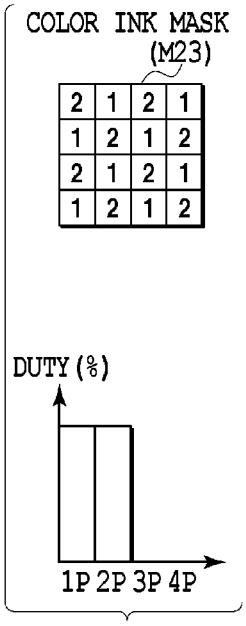
Figure 15D:
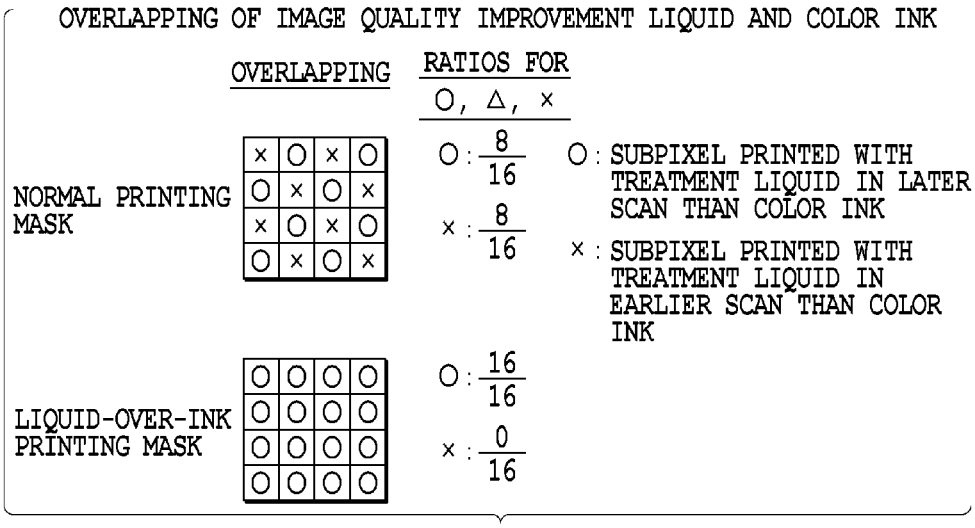

Next, a second embodiment of this invention will be described. The second embodiment is basically similar to the first embodiment, except for the characteristic functions of the second embodiment described below. Of the image quality improvement liquid masks used in the first embodiment, the liquid-over-ink printing mask has a higher duty in the latter half scans than the normal printing mask. In the second embodiment, masks shown in FIGS. 15A-15C are used in combination to more efficiently control the gloss level and image clarity.

That is, in the second embodiment, the normal printing mask M21, which applies the image quality improvement liquid in the same scan that completes an image with color inks, and the liquid-over-ink printing mask M22, which applies the image quality improvement liquid following the scan that has completed an image with color inks, are used in combination. FIG. 15A schematically shows the normal printing mask M21 and its duty; FIG. 15B schematically shows the liquid-over-ink printing mask M22 and its duty; and FIG. 15C schematically shows a color ink mask and its duty.

In the multipass printing method that completes the printing operation with four print scans, the normal printing mask M21 and the color ink mask M23 both complete the application of the image quality improvement liquid and color inks in the first two scans. The liquid-over-ink printing mask M22 completes the application of the image quality improvement liquid in the last two scans.

FIG. 13D shows how the inks and the image quality improvement liquid are overlapped. ○ represents areas where the image quality improvement liquid is applied in a scan following the ink application scan. x represents areas where the image quality improvement liquid is applied in a scan preceding the ink application scan. As shown in FIG. 13D, the combined use of the color ink mask M23 and the liquid-over-ink printing mask M22 allows the image quality improvement liquid to be applied over the color inks. Therefore, only the gloss level can be efficiently controlled without degrading the clarity of the image, alleviating the glossiness unevenness, which in turn assures the printing of an image with uniform glossiness.

(Third Embodiment)

Next, a third embodiment of this invention will be described. The third embodiment is basically similar to the first embodiment, except for the characteristic functions of the third embodiment. In the first embodiment, the method of applying the image quality improvement liquid is chosen according to the volume of inks applied to a unit area. In the third embodiment, on the other hand, the selection of the image quality improvement liquid application method is made according to the number of inks used for the printing in the unit area, i.e., depending on whether the inks printed in the unit area are primary colors, secondary colors or tertiary colors, as well as the volume of color inks applied.

FIG. 16 is a table showing a relation among the number of inks used to print an image in predetermined area, the volume of inks applied and the mask to be selected. An area printed with a greater number of inks tends to have a lower image clarity. So, for areas that are printed with primary colors and has an applied ink volume of less than 75%, a normal printing mask is selected as the image quality improvement liquid mask. For areas with an applied ink volume of 75% or more, a liquid-over-ink printing mask is chosen. For areas that are printed with secondary colors and has an applied ink volume of less than 50%, a normal printing mask is selected. For areas with an applied ink volume of 50% or more, a liquid-over-ink printing mask is selected. Further, for areas that are printed with tertiary colors and has an applied ink volume of less than 15%, a normal printing mask is selected and, for areas with an applied ink volume of 15% or more, a liquid-over-ink printing mask is selected.

As described above, in the third embodiment, since a selection is made of whether the image quality improvement liquid is applied by the normal printing procedure or the liquid-over-ink printing procedure according to the number of inks used and the applied ink volume, the gloss level and the image clarity can be controlled more precisely, offering printed images with more uniform glossiness.

(Fourth Embodiment)

Next, a fourth embodiment of this invention will be described. The fourth embodiment is basically similar to the first embodiment, except for the characteristic functions of the fourth embodiment. In the first embodiment, a selection is made of the image quality improvement liquid mask according to the total volume of color inks applied to a predetermined area. In the fourth embodiment the mask selection is made according to the volumes of individual color inks. This arrangement is made because the image clarity of printed images depends not only on the total volume of inks used but also on their combination.

FIG. 17 shows an example table, from which an image quality improvement liquid application method is selected according to the volumes of cyan ink (C ink) and magenta ink (M ink) used to form a normal color (secondary color). As shown in the table, depending on the applied volumes of C ink and M ink, a decision is made as to which of the normal printing and the liquid-over-ink printing is used. This allows the gloss level and the image clarity to be controlled according to the volume of each color ink printed.

Although, in the above example table of FIG. 17 for selecting the image quality improvement liquid application method, a secondary color used to form an image has been described to be made from a combination of C ink and M ink, similar selection tables for determining the image quality improvement liquid application method according to the applied volumes of individual inks are also provided for other secondary colors formed from other combinations of color inks. Further, while this fourth embodiment has described an example case of forming an image of secondary colors, it is also possible to provide similar selection tables when an image is formed with tertiary or higher order colors. That is, this invention allows the selection tables for image quality improvement liquid application method to be set also for tertiary or higher order colors as long as the number of inks used to form normal colors is within the number of color inks mounted in the printing apparatus.

(Fifth Embodiment)

Next, a fifth embodiment of this invention will be described. The fifth embodiment is basically similar to the first embodiment, except for the characteristic functions of the fifth embodiment described below. In the first embodiment, the 4×4 areas are taken as a unit area for the mask and, based on the print data corresponding to the unit mask area, the total volume of all color inks applied is calculated. Based on the calculated ink volume, a image quality improvement liquid mask is selected. In the fifth embodiment, on the other hand, 2×2 pixels (8×8 areas) are used as a unit mask area for which the volume of all color inks applied are calculated.

FIGS. 18A-18C show areas for image data used for calculating the total applied ink volume and the corresponding unit mask areas. FIG. 18A is a diagram showing total applied ink volumes in individual pixel areas. FIG. 18B shows the kind of mask for the image quality improvement liquid selected in the first embodiment. FIG. 18C shows the kind of mask for the image quality improvement liquid selected in the fifth embodiment. The fifth embodiment will be explained in comparison with the first embodiment.

As described above, in the first embodiment, the total applied ink volume of color inks applied is calculated for the 1-pixel image data (17 gradation values) to generate selection data for the image quality improvement liquid mask (step S1-S6). Based on the mask selection data, the masking process is performed on the image quality improvement liquid print data by using the 4×4-area mask pattern. Here the selection of a mask used for the application of the image quality improvement liquid is done as shown in FIG. 18B. That is, when the applied color ink volume in the 4×4-area is less than 50%, a normal printing mask (indicated at A in the figure) is selected. When the applied ink volume is 50% or greater, a liquid-over-ink printing mask (B in the figure) is selected.

In the fifth embodiment, on the other hand, a mask selection is made for the 17-gradationgradation value image data in every 2×2 (4) pixels based on an average of the total applied ink volumes in these 4 pixels. That is, for every 2×2 (4) pixels shown in FIG. 18A, an average of total applied ink volumes is calculated from the 17-gradationgradation value image data. If the average is found to be less than 50%, the normal printing mask (indicated at A in the figure) is selected. If the average is 50% or more, the liquid-over-ink printing mask (B in the figure) is selected. Referring to FIG. 18A, the total applied ink volumes in four pixels are 30%, 30%, 60% and 40%, and their average is 40%. So, all the four pixels are processed by the normal printing mask (A). Similarly, in the next unit mask area in FIG. 18A, the applied ink volumes for the four pixels are 30%, 100%, 30% and 120%, and their average is 70%. So, all the four pixels are processed by the normal printing mask (B). Further next, the total applied ink volume for the four pixels are 110%, 120%, 110% and 130%, and their average is 117.5%. Therefore, all the four pixels are processed by the liquid-over-ink printing mask (B).

As described above, the unit area of the image data used for mask selection may include a plurality of pieces of gradation data. In this embodiment, the mask selection is made based on the average of the total applied ink volumes in the 2×2-pixel unit area of the 17-gradation value image data. The unit area is not limited to 2×2 pixels. Further, the image quality improvement liquid mask selection method is not limited to the one based on the ink volume average, as long as it performs the mask processing. For example, when there are any pixels in a 17-gradation value unit area that have a total applied ink volume less than a predetermined value, their total applied ink volumes may be weighted in calculating an overall applied ink volume in the whole unit area and, based on the calculated value, the image quality improvement liquid mask may be selected.

(Sixth Embodiment)

Figure 19:
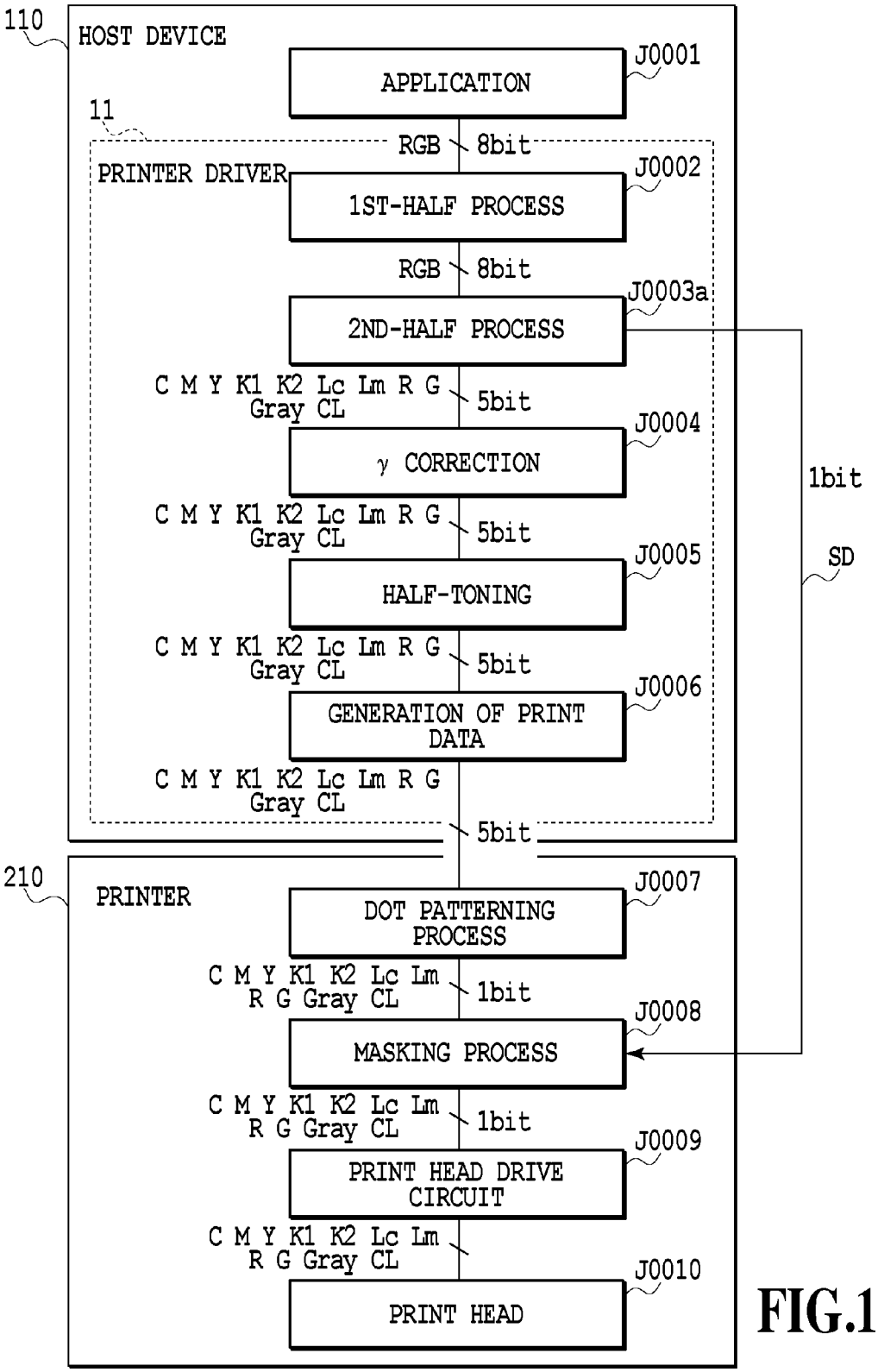
FIG. 19 is a block diagram showing a sequence of steps in an image data conversion operation in a sixth embodiment.

Next, a sixth embodiment of this invention will be described. The sixth embodiment is basically similar to the first embodiment, except for the characteristic functions of the sixth embodiment described below. The sixth embodiment uses multivalued image data (256-gradationgradation value image data) before being quantized, as the information corresponding to the volume of color inks applied. That is, the sixth embodiment selects an image quality improvement liquid mask based on the input of 256-value image data after being processed by the precedent process J0002, as shown in FIG. 19. Except for a subsequent process/mask selection operation J0003*a* and a mask selection data generation operation J0003*b*, this embodiment has the similar operations to those of the first embodiment.

Figure 20:
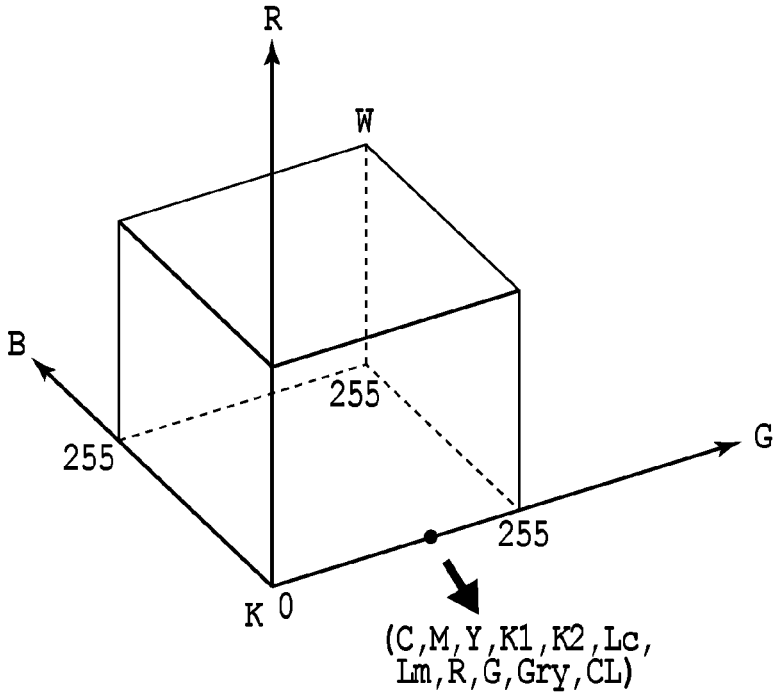
FIG. 20 shows a three-dimensional LUT used in the first embodiment.

In the first embodiment, the subsequent process J0003 converts the supplied RGB image data into color separation data C, M, Y, K1, K2, LM, LC, R, Gray and CL according to the three-dimensional LUT for the subsequent process. FIG. 20 is a conceptual diagram of the three-dimensional LUT. FIG. 20 shows that lattice points of 256-gradationgradation value RGB values that can be reproduced by the printing apparatus are assigned the corresponding values of C, M, Y, K1, K2, LM, LC, R, G, Gray and CL. (R, G, B)=(0, 0, 0) represents black with the lowest luminance and (R, G, B)=(255, 255, 255) represent white with the highest luminance.

The sixth embodiment adds mask selection information to the three-dimensional LUT. That is, the sixth embodiment in the subsequent process/mask selection operation J0003*a* of FIG. 19 generates mask selection data (mask selection information) SD based on the three-dimensional LUT of this embodiment and transfers the selection data to the masking process J0008.

Figure 21:
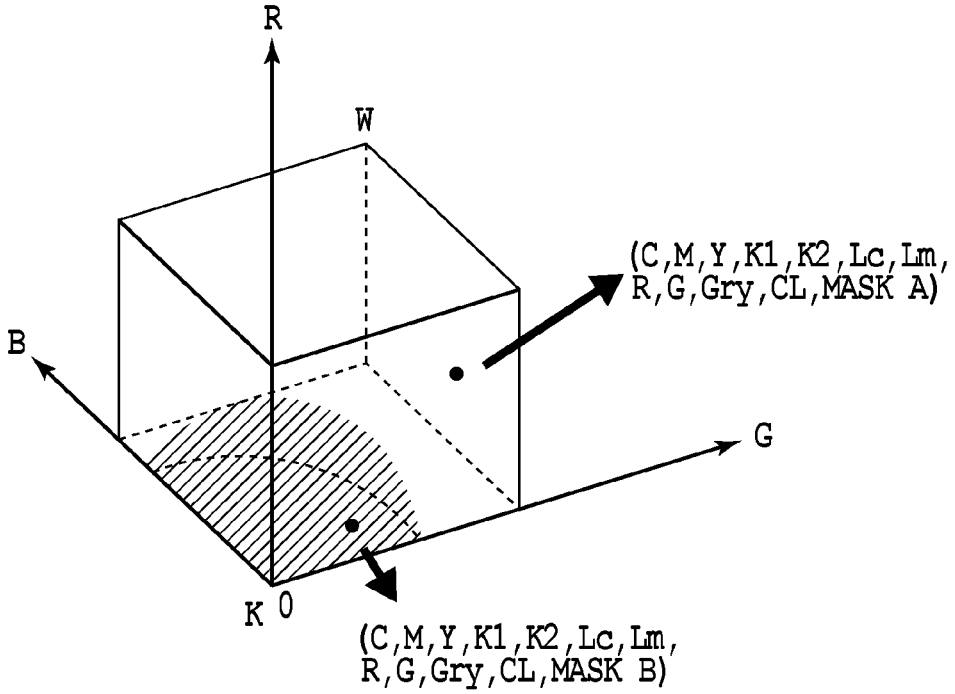
FIG. 21 shows a three-dimensional LUT used in the sixth embodiment.

FIG. 21 shows a three-dimensional LUT used in the sixth embodiment. The three-dimensional LUT shown here has a normal printing mask (A) or liquid-over-ink printing mask (B) as the mask selection data. In the inkjet printing, shadow regions tend to have a larger number of color inks applied and a greater volume of inks applied than other gradation value do. For example, a black ink is used in addition to chromatic inks. When composite colors from C, M and Y are used, the total applied ink volume increases. So, in shadow regions including the darkest region (shadowed region in FIG. 21), the liquid-over-ink printing mask (B) is used. In other regions the normal printing mask (A) is selected.

Figure 22:
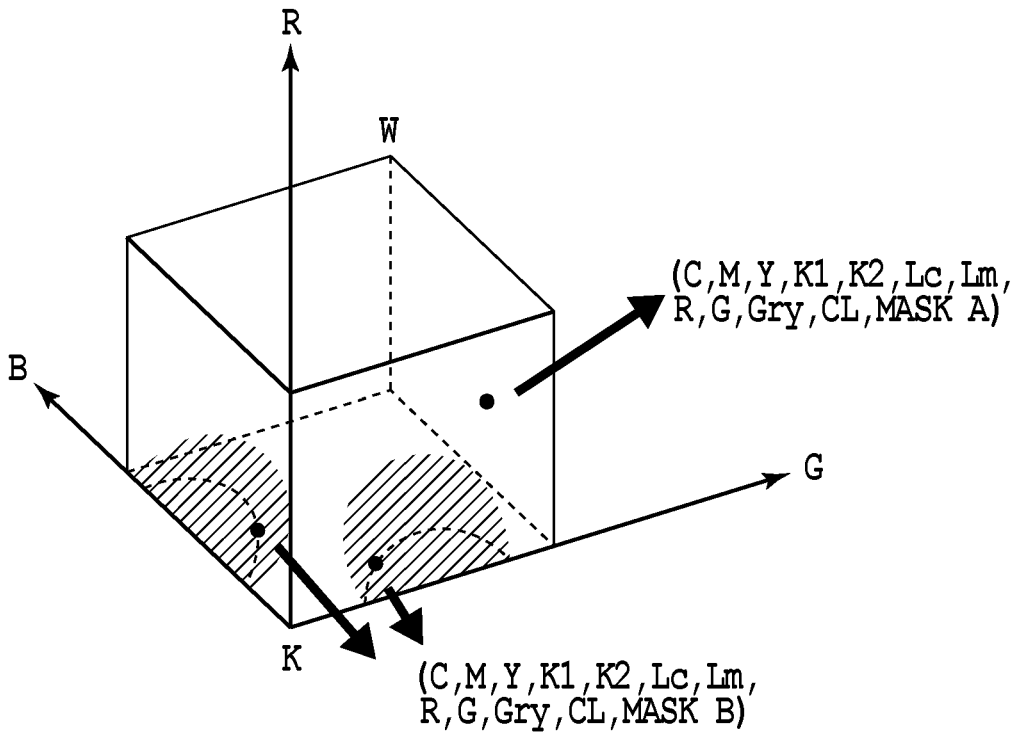
FIG. 22 shows another example of the three-dimensional LUT used in the sixth embodiment.

As described above, the mask selection may be made according to the 256-gradation value image data before being quantized. That is, where the gradation value of an image represented by image data is less than a predetermined value, the normal printing mask (A) is selected. Where the gradation value of an image is equal to or more than the predetermined value, the liquid-over-ink printing mask (B) is selected. In this embodiment, the mask selection is switched between the shadow region and other regions. That is, it is changed according to brightness. It is noted, however, that the mask selection is not limited to this method. The sixth embodiment is characterized in that the uniformity of gloss level and image clarity are improved by selecting the image quality improvement liquid mask based on the RGB value as information representing the volume of inks applied. Therefore, other mask selection methods using the RGB value can be employed as long as they are similarly effective in the mask selection. For example, as shown in FIG. 22, the liquid-over-ink printing mask (B) may be chosen in specified ranges of hue and chroma (shaded ranges). The input image data is not limited to RGB but may include image data represented by L*a*b* or even data that has been converted into a plurality of color inks.

(Other Embodiments)

In the first embodiment, the precedent process J0002, subsequent process J0003, γ correction process J0004, quantization process J0005 and print data generation process J0006 are executed by the print data generation process J0006, as shown in FIG. 8. It is also configured that the dot patterning process J0007 and the masking process J0008 are executed by the printer 210. It is noted, however, that this invention is not limited to this configuration. For example, a part of the operations J0002-J0005 executed by the host device 110 may be performed by the printer 210 or all of the operations may be performed by the host device 110. Further, the processes J0002-J0008 may be executed by the printer 210.

Further, in the first embodiment, the volume of color inks ejected is calculated from the 17-value image data that has undergone the print data generation process J0006 and, based on the calculated ink volume, an image quality improvement liquid mask is selected. This invention is not limited to this method. As the information representing the volume of applied color inks, the binary image data that has undergone the dot patterning process may be used. In that case, after the image data is developed into binary data, the number of areas that are printed with a dot may be counted to select the mask. For example, in the dot positioning pattern shown in FIG. 10, it is counted how many of the 16 areas that constitute a unit area are printed with an ink dot. If the count is between 0 and 10 areas, the normal printing mask is chosen. If the count is between 10 and 16 areas, the liquid-over-ink printing mask is selected.

In the second embodiment, for each insertion of a print medium, four print scans are performed to apply color inks and image quality improvement liquid before completing the printing and discharging the printed medium. This invention is not limited to this configuration. For example, on insertion of the print medium, the normal printing of the color inks and the image quality improvement liquid may be executed in two scans before discharging the printed medium and the user may manually insert the same print medium again into the printer. The print medium is inserted two times to feed it to the printing unit two or more times. This action may be done automatically by a mechanism that switches back the printed medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-194735, filed Aug. 31, 2010, which is hereby incorporated by reference herein in its entirety.

What is claimed is:

1. An inkjet printing apparatus comprising:

a print head configured to: (i) eject a plurality of kinds of color inks with mutually different colors, each ink containing a colorant, in accordance with image data of an image to be formed on a print medium, and (ii) eject an image quality improvement liquid for changing a gloss level or image clarity, wherein the print head is further configured to be scanned over a unit area of the print medium a plurality of times to form an image on the print medium with the color inks and to apply the image quality improvement liquid;

a determining unit configured to determine a number of kinds of color inks used for printing in the unit area based on image data, of the image, corresponding to the unit area; and a control unit configured to control a volume of the image quality improvement liquid applied to the unit area by the print head in each of the plurality of scans by determining a permitted volume of the image quality improvement liquid to be applied to the unit area in each of the plurality of scans according to the number of kinds of color inks determined by the determining unit.

2. An inkjet printing apparatus according to claim 1, wherein the control unit controls the volume of the image quality improvement liquid applied to the unit area by dividing print data, that causes the print head to eject the image quality improvement liquid onto the unit area, into pieces of print data respectively corresponding to the plurality of scans using a mask for determining a percentage of print-permitted areas in the unit area for each of the plurality of scans.

3. An inkjet printing apparatus according to claim 2, further comprising:

a memory configured to store a first mask and a second mask, wherein the second mask is so arranged that its percentage of the print-permitted area for a latter half of the plurality of scans is higher than that of the first mask; and a selection unit configured to select either the first mask or the second mask as the mask according to the total volume of the color inks and the number of kinds of color inks, wherein when the number of kinds of color inks is a first number, the selection unit selects (i) the first mask when a total volume of the color inks applied to the unit area is less than a predetermined volume, and (ii) the second mask when the total volume of the color inks applied to the unit area is equal to or more than the predetermined volume.

4. An inkjet printing apparatus according to claim 3, wherein the second mask is used to generate the pieces of print data for scans performed, after the image has been formed with the color inks, to eject the image quality improvement liquid onto the formed image.

5. An inkjet printing apparatus according to claim 3, wherein the first mask is used to generate the pieces of print data for scans that complete the image with the color inks and eject the image quality improvement liquid, and wherein the second mask is used to generate the pieces of print data for scans performed, after the image has been completed with the color inks, to eject the image quality improvement liquid.

6. An inkjet printing apparatus according to claim 2, further comprising:

a memory configured to store a first mask and a second mask, wherein the second mask is so arranged that its percentage of print-permitted area for a latter half of the plurality of scans is higher than that of the first mask; and a selection unit configured to select either the first mask or the second mask as the mask, according to the number of kinds of color inks, wherein when the total volume of the color inks is a predetermined volume, the selection unit selects (i) the first mask when the number of kinds of color inks is a first number and (ii) the second mask when the number of kinds of color inks is a second number higher than the first number.

7. An inkjet printing apparatus according to claim 2, further comprising:

a memory configured to store a first mask and a second mask, wherein the second mask is so arranged that its percentage of the print-permitted area for a last scan of the plurality of scans is higher than that of the first mask; and a selection unit configured to select either the first mask or the second mask as the mask, according to the total volume of the color inks and the number of kinds of color inks, wherein when the total volume of the color inks is a predetermined volume, the selection unit selects (i) the first mask when the number of kinds of color inks is a first number and (ii) the second mask when the number of kinds of color inks is a second number higher than the first number.

8. An inkjet printing apparatus according to claim 1, wherein each of the color inks contain a pigment colorant.

9. An inkjet printing apparatus, in which a print head that ejects at least one color ink, containing a colorant, and an image quality improvement liquid is scanned over a same print area of a print medium a plurality of times to form an image on the print medium with the at least one color ink and apply the image quality improvement liquid onto the printed image to change its gloss level or image clarity, the inkjet printing apparatus comprising:

a control unit configured to control a volume of the image quality improvement liquid applied to unit areas included in the print area in each of the plurality of scans, wherein the control unit uses a mask to divide print data, that causes the print head to eject the image quality improvement liquid onto the unit areas, into pieces of print data respectively corresponding to the plurality of scans; and a selection unit configured to select either a first mask or a second mask as the mask according to a gradation value of an image represented by input image data for the unit areas included in the print area, wherein the second mask is so arranged that its print ratio of the print data becomes increasingly higher than that of the first mask towards an end of the plurality of scans, and wherein the selection unit selects (i) the first mask when the gradation value of the image represented by the input image data for the unit areas is less than a predetermined level, and (ii) the second mask when the gradation value of the image represented by the input image data for the unit areas is greater than or equal to the predetermined level.

10. An inkjet printing apparatus according to claim 9, wherein the input image data is image data represented by RGB or L*a*b* or image data that has undergone color conversion into color ink data.

11. An inkjet printing method, comprising the steps of:

ejecting (i) a plurality of kinds of color inks with mutually different colors, each ink containing a colorant, in accordance with image data of an image to be formed on a print medium, and (ii) an image quality improvement liquid for changing a gloss level or image clarity using a print head configured to eject the plurality of kinds of color inks and the image quality improvement liquid, wherein the print head is scanned over a unit area of a print medium a plurality of times to form an image on the print medium with the color inks and to apply the image quality improvement liquid;

determining a number of kinds of color inks used for printing in the unit area based on image data, of the image, corresponding to the unit area; and controlling, with a control unit, a volume of the image quality improvement liquid applied to the unit area by the print head in each of the plurality of scans by determining a permitted volume of the image quality improvement liquid to be applied to the unit area in each of the plurality of scans according to the number of kinds of color inks determined in the determining step.

12. An inkjet printing method according to claim 11, wherein the control unit controls the volume of the image quality improvement liquid applied to the unit area by dividing print data, that causes the print head to eject the image quality improvement liquid onto the unit area, into pieces of print data respectively corresponding to the plurality of scans using a mask for determining a percentage of the print-permitted areas in the unit area for each of the plurality of scans.

13. An inkjet printing method according to claim 12, further comprising:

storing, with a memory, a first mask and a second mask, wherein the second mask is so arranged that its percentage of the print-permitted area for a latter half of the plurality of scans is higher than that of the first mask; and selecting, with a selection unit, either the first mask or the second mask as the mask according to the total volume of the color inks and the number of kinds of color inks, wherein when the number of kinds of color inks is a first number, the selection unit selects (i) the first mask when a total volume of the color inks applied to the unit area is less than a predetermined volume, and (ii) the second mask when the total volume of the color inks applied to the unit area is equal to or more than the predetermined volume.

14. An inkjet printing method according to claim 13, wherein the second mask is used to generate the pieces of print data for scans performed, after the image has been formed with the color inks, to eject the image quality improvement liquid onto the formed image.

15. An inkjet printing method according to claim 13, wherein the first mask is used to generate the pieces of print data for scans that complete the image with the color inks and eject the image quality improvement liquid, and wherein the second mask is used to generate the pieces of print data for scans, performed after the image has been completed with the color inks, to eject the image quality improvement liquid.

16. An inkjet printing method according to claim 12, further comprising:

storing, with a memory, a first mask and a second mask, wherein the second mask is so arranged that its percentage of the print-permitted area for a latter half of the plurality of scans is higher than that of the first mask; and selecting, with a selection unit, either the first mask or the second mask as the mask, according to the number of kinds of color inks, wherein when the total volume of the color inks is a predetermined volume, the selection unit selects (i) the first mask when the number of kinds of color inks is a first number volume and (ii) the second mask when the number of kinds of color inks is a second number higher than the first number.

17. An inkjet printing method according to claim 12, further comprising:

storing, with a memory, a first mask and a second mask, wherein the second mask is so arranged that its percentage of the print-permitted area for a last scan of the plurality of scans is higher than that of the first mask; and selecting, with a selection unit, either the first mask or the second mask as the mask, according to the total volume of the color inks and the number of kinds of color inks, wherein when the total volume of the color inks is a predetermined volume, the selection unit selects (i) the first mask when the number of kinds of color inks is a first number volume and (ii) the second mask when the number of kinds of color inks is a second number higher than the first number.

18. An inkjet printing method according to claim 11, wherein each of the color inks contain a pigment colorant.

19. An inkjet printing apparatus comprising:

a print head configured to: (i) eject a plurality of kinds of color inks with mutually different colors according to image data of an image to be formed on print medium, each ink containing a colorant, and (ii) eject an image quality improvement liquid for changing a gloss level or image clarity, wherein the print head is further configured to be scanned over a unit area of a print medium a plurality of times to form an image on the print medium with the color inks and to apply the image quality improvement liquid;

an obtaining unit configured to obtain RGB valued image data of the image corresponding to the unit area;

a conversion unit configured to convert the RGB valued image data obtained by the obtaining unit into color separation data corresponding to volumes of each of the plurality of kinds of color inks and the image quality improvement liquid;

a determining unit configured to determine a volume of the image quality improvement liquid applied to the unit area in each of the plurality of scans based on the RGB valued image data obtained by the obtaining unit, and a control unit configured to cause the print head to apply the plurality of kinds of color inks to the unit area based on the color separation data obtained by the conversion by the conversion unit and to apply the image quality improvement liquid to the unit area in each of the plurality of scans according to the determination by the determining unit.

20. An inkjet printing apparatus according to claim 19, wherein the control unit controls the volume of the image quality improvement liquid applied to the unit area by dividing print data, that causes the print head to eject the image quality improvement liquid onto the unit area, into pieces of print data respectively corresponding to the plurality of scans using a mask for determining a percentage of print-permitted areas in the unit area for each of the plurality of scans.

21. An inkjet printing apparatus according to claim 20, further comprising:

a memory configured to store a first mask and a second mask, wherein the second mask is so arranged that its percentage of the print-permitted area for a latter half of the plurality of scans is higher than that of the first mask; and a selection unit configured to select either the first mask or the second mask as the mask according to the RGB valued image data obtained by the obtaining unit, wherein the selection unit selects (i) the first mask when a lightness based on the RGB valued the image data is equal to or more than a predetermined value and (ii) the second mask when the lightness based on the RGB valued image data is not more than the predetermined value.

22. An inkjet printing apparatus according to claim 21, wherein the second mask is used to generate the pieces of print data for scans performed, after the image has been formed with the color inks, to eject the image quality improvement liquid onto the formed image.

23. An inkjet printing apparatus according to claim 21, wherein the first mask is used to generate the pieces of print data for scans that complete the image with the color inks and eject the image quality improvement liquid, and wherein the second mask is used to generate the pieces of print data for scans performed, after the image has been completed with the color inks, to eject the image quality improvement liquid.

24. An inkjet printing apparatus according to claim 21, wherein the second mask is used to generate the pieces of print data for scans performed, after the image has been completed with the color inks, to eject the image quality improvement liquid.

25. An inkjet printing apparatus according to claim 19, wherein the color inks each contain a pigment colorant.

26. An inkjet printing apparatus according to claim 19, wherein the image quality improvement liquid is transparent liquid.

27. An inkjet printing apparatus according to claim 19, wherein the conversion unit includes the determining unit.

28. An inkjet printing apparatus according to claim 19, wherein the conversion unit is further configured to convert the RGB valued image data obtained by the obtaining unit into the color separation data using a three-dimensional lookup table, wherein the three-dimensional lookup table includes determining information indicating the volume of the image quality improvement liquid applied to the unit area in each of the plurality of scans corresponding to RGB valued image data, and wherein the determining unit is further configured to determine the volume of the image quality improvement liquid applied to the unit area in each of the plurality of scans based on the RGB valued image data obtained by the obtaining unit and the determining information included in the three-dimensional lookup table.

29. An inkjet printing apparatus according to claim 28, further comprising:

a memory storing the three-dimensional lookup table.

30. An inkjet printing apparatus according to claim 19, further comprising:

a memory configured to store a plurality of masks for determining a percentage of print-permitted areas in the unit area for each of the plurality of scans, wherein the conversion unit is further configured to convert the RGB valued image data obtained by the obtaining unit into the color separation data by using a three-dimensional table stored in the memory, wherein the three-dimensional table includes determining information indicating the mask corresponding to the RGB valued image data, and wherein the determining unit selects a mask used for determining a percentage of print-permitted areas in the unit area for each of the plurality of scans from the plurality of masks based on the RGB valued image data obtained by the obtaining unit and the determining information included in the three-dimensional lookup table.

* * * * *